US010185244B2

(12) United States Patent
Kano

(10) Patent No.: US 10,185,244 B2
(45) Date of Patent: Jan. 22, 2019

(54) DEVELOPING DEVICE AND IMAGE FORMING APPARATUS INCLUDING THE SAME

(71) Applicant: Sharp Kabushiki Kaisha, Sakai, Osaka (JP)

(72) Inventor: Tadanori Kano, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 15/716,271

(22) Filed: Sep. 26, 2017

(65) Prior Publication Data

US 2018/0088489 A1 Mar. 29, 2018

(30) Foreign Application Priority Data

Sep. 26, 2016 (JP) ..... 2016-186885

(51) Int. Cl.
*G03G 15/08* (2006.01)
*G03G 15/09* (2006.01)

(52) U.S. Cl.
CPC ..... *G03G 15/0812* (2013.01); *G03G 15/0928* (2013.01)

(58) Field of Classification Search
CPC ..... G03G 15/0812; G03G 15/0928
See application file for complete search history.

(56) References Cited

U.S. PATENT DOCUMENTS 4,235,194 A * 11/1980 Wada ..... G03G 15/09 222/DIG. 1
4,377,334 A * 3/1983 Nishikawa ..... G03G 15/0942 399/103
5,143,017 A * 9/1992 Haneda ..... G03G 15/0822 399/256
2009/0245888 A1* 10/2009 Akedo ..... G03G 15/0928 399/276
2012/0008988 A1* 1/2012 Kunihiro ..... G03G 15/0822 399/254
2016/0091829 A1* 3/2016 Noguchi ..... G03G 15/0921 399/254
2016/0246212 A1* 8/2016 Tauchi ..... G03G 15/0808

FOREIGN PATENT DOCUMENTS

JP 2014-215403 A 11/2014

* cited by examiner

*Primary Examiner* — Rodney Bonnette
(74) *Attorney, Agent, or Firm* — ScienBiziP, P.C.

(57) ABSTRACT

A developing device includes a magnet roller, a developing sleeve that revolves in a predetermined direction of revolution around the magnet roller, a developer tank having an opening that forms a development region by opening a part of a surface of the developing sleeve in a circumferential direction, a regulating member that regulates a layer thickness of a developer on the surface of the developing sleeve, and a toner residue reduction member that reduces a residue of a toner adhering directly to the surface of the developing sleeve.

11 Claims, 21 Drawing Sheets

DEVELOPING DEVICE AND IMAGE FORMING APPARATUS INCLUDING THE SAME

BACKGROUND

1. Field

The present disclosure relates to a developing device that is used in an image forming apparatus such as a copier, a multifunctional printer, a printer, a facsimile apparatus and an image forming apparatus including the developing device.

2. Description of the Related Art

An image forming apparatus such as a copier, a multifunctional printer, a printer, a facsimile apparatus is configured to, for example, in electrophotographically forming an image, charge a surface of an electrostatic latent image support such as a photoreceptor, form an electrostatic latent image by performing image exposure in the charged region, visualize (develop) the electrostatic latent image as a toner image, transfer the toner image thus visualized onto an intermediate transfer body such as an intermediate transfer belt or a recording material such as a sheet of paper, further transferring the toner image onto the recording material when having transferred the toner image onto the intermediate transfer body, and fixing the toner image to the recording material onto which the toner image has been transferred.

In general, a developing device that is used in such an image forming apparatus includes a magnet roller, a developing sleeve that revolves in a predetermined direction of revolution around the magnet roller, a developer tank having an opening that forms a development region by opening a part of a surface of the developing sleeve in a circumferential direction, and a regulating member that regulates a layer thickness of a developer on the surface of the developing sleeve. Note here that possible examples of the developer include a two-component developer (i.e. a developer composed mainly of a toner and a carrier) and a magnetic single-component developer (i.e. a developer composed mainly of a magnetic toner). Further, in using the developer to develop the electrostatic latent image formed on the electrostatic latent image support, a developing bias voltage is applied between the developing sleeve and the electrostatic latent image support.

Depending on the composition of the developer (in the case of the two-component developer, the toner and/or the carrier, or in the case of the magnetic single-component developer, the magnetic toner), the state of external additives, and/or the properties (e.g. surface material and/or surface treatment) of the surface of the developing sleeve, such a developing device may suffer from a residue of the toner adhering directly to the surface of the developing sleeve due to forces of adhesion such as van der Waals forces, although the toner is supposed to be released from the surface of the developing sleeve by centrifugal force generated by the revolution of the developing sleeve after the end of a developing process of developing the electrostatic latent image being supported the electrostatic latent image support. The residue of the toner adhering directly to the surface of the developing sleeve remains with charge generated by the previous image and therefore differs in amount of charge from a portion of the toner newly drawn up onto the surface of the developing sleeve by the next revolution, thus inconveniently affecting the next image to be developed.

Furthermore, while the developer on the surface of the developing sleeve is supposed to be replaced with a new developer every time the developing sleeve revolves, a portion of the toner remains (stays) in the same place on the surface of the developing sleeve, and depending on the direction in which the developing bias voltage is applied, the toner is pressed against the surface of the developing sleeve, with the result than the toner may adhere firmly no the surface of the developing sleeve. Then, the layer of the toner having adhered to the surface of the developing sleeve weakens the magnetic force of the magnet roller, lowers the amount of the developer that is conveyed on the surface of the developing sleeve, and by extension inconveniently invites shortening of the life of the developing sleeve.

It is conceivable that such inconveniences may be obviated, for example, by repeating experiments with slight variations in the composition of the developer (in the case of the two-component developer, the toner and/or the carrier, or in the case of the magnetic single-component developer, the magnetic toner), the state of external additives, and/or the properties (e.g. surface material and/or surface treatment) of the surface of the developing sleeve and thereby finding out such a combination of the composition of the developer, the state of external additives, and/or the properties of the surface of the developing sleeve as to reduce a residue of the toner adhering directly to the surface of the developing sleeve. In this case, however, an enormous number of experiments need to be conducted, thus entailing much labor.

To address this problem, Japanese Unexamined Patent Application Publication No. 2014-215403 discloses specifying the particle diameter of the toner and the average degree of circularity of the toner and thereby reducing a residue of the toner adhering directly to the surface of the developing sleeve.

However, the method disclosed in Japanese Unexamined Patent Application Publication No. 2014-215403 is limited in scope of toner to be used and is high in cost of usage of toner.

SUMMARY

It is desirable to provide a developing device that makes it possible to, without entailing the labor of conducting an enormous number of experiments, reduce a residue of a toner adhering directly to a surface of a developing sleeve and, what is more, to use the toner with no limitations on the particle diameter, the average degree of circularity, or the like and an image forming apparatus including the developing device.

According to an aspect of the disclosure, there is provided a developing device including a magnet roller, a developing sleeve that revolves in a predetermined direction of revolution around the magnet roller, a developer tank having an opening that forms a development region by opening a part of a surface of the developing sleeve in a circumferential direction, a regulating member that regulates a layer thickness of a developer on the surface of the developing sleeve, and a toner residue reduction member that reduces residue of a toner adhering directly to the surface of the developing sleeve.

According to another aspect of the disclosure, there is provided an image forming apparatus including the developing device according to the aforementioned aspect.

DESCRIPTION OF THE EMBODIMENTS

An embodiment of the present disclosure is described below with reference to the drawings.

Image Forming Apparatus

Figure 1:
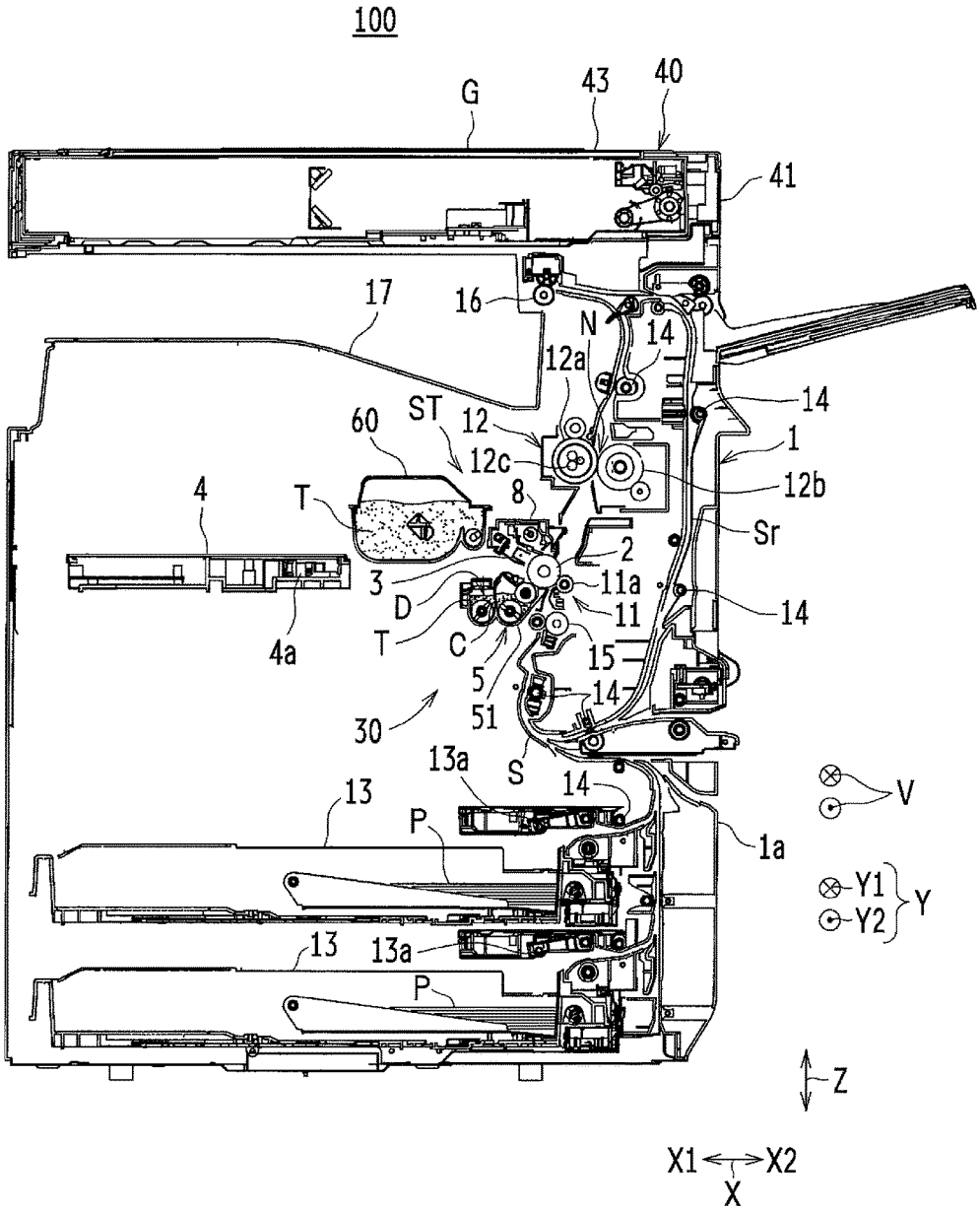
FIG. 1 is a cross-sectional view schematically showing a configuration of an internal structure of an image forming apparatus including a developing device according to an embodiment of the present disclosure.

FIG. 1 is a cross-sectional view schematically showing a configuration of an internal structure of an image forming apparatus 100 including a developing device 5 according to an embodiment of the present disclosure. It should be noted that FIG. 1 omits to illustrate the after-mentioned toner residue reduction member 500.

The image forming apparatus 100 according to the present embodiment is a monochromatic image forming apparatus. It should be noted that, instead of being a monochromatic image forming apparatus, the image forming apparatus 100 may for example be an intermediate transfer color multi-functional printer that can form a full-color image. Specifically, the image forming apparatus 100 may be a so-called tandem color image forming apparatus configured such that a plurality of electrostatic latent image supports (specifically, photoreceptors) on which toner images are formed, respectively, are laid side by side in a predetermined direction (in this example, a horizontal direct ion X). Alternatively, the image forming apparatus 100 may be another color image forming apparatus.

The image forming apparatus 100 forms an image through the developing device 5 (specifically, a developing unit), which is detachable from an image forming apparatus main body 1.

The image forming apparatus 100 includes an image forming station ST, an exposure device 4 (specifically, an exposure unit), a transfer device 11 (specifically, a transfer unit), a fixing device 12 (specifically, a fixing unit), a paper feed device 13 (specifically, a paper feed unit) that accommodates recording materials P such as recording paper, and a main body frame 1*a*.

The main body frame 1*a* supports constituent members of the image forming apparatus main body 1 such as an image forming section 30, the transfer device 11, and the fixing device 12 and constitutes a housing and support frame of the image forming apparatus main body 1. In this example, the image forming section 30 is constituted by the image forming station ST and the exposure device 4. It should be noted that the image forming section 30 may be further constituted by the transfer device 11 and/or the fixing device 12.

The image forming apparatus 100 has an image reading device 40 provided on top of the image forming apparatus main body 1. The image reading device 40 includes an image reading section 41 for reading an image of a document G, a document conveying section (not illustrated) that conveys the document 40, and a platen 43 on which the document G is placed.

The image reading device 40 uses the image reading section 41 to either read the document G being conveyed by the document conveying section (not illustrated) or read the document G placed on the platen 43. The image of the document G as read by the image reading device 40 is sent as image data to the image forming apparatus main body 1, or image data from an external device is sent to the image forming apparatus main body 1, and an image formed on the basis of the image data in the image forming apparatus main body 1 is recorded on a recording material P.

The image forming station ST includes a photoreceptor 2 (specifically, a photosensitive drum), a charging device 3 (specifically, a charging unit), the developing device 5, and a photoreceptor cleaning device 8 (specifically, a photoreceptor cleaning unit). The charging device 3, the developing device 5, and the photoreceptor cleaning device 8 are arranged in this order around the photoreceptor 2. It should be noted that, in this example, the charging device 3 and the photoreceptor cleaning device 8 are integrally formed.

In the image forming station ST, a toner cartridge in which a black (B) toner T is accommodated is detachably connected to the developing device 5, and while the toner T is being supplied from the toner cartridge 60 to the developing device 5, a black (B) toner image is formed on the photoreceptor 2 by a developer D in the developing device 5. Possible examples of the developer D include a two-component developer (i.e. a developer composed mainly of a toner an( a carrier) and a magnetic single-component developer (i.e. a developer composed mainly of a magnetic toner). In this example, the developing device is constituted as a developing device that uses, as the developer D, a two-component developer composed mainly of the toner T and a carrier C. Further, in using the developer D to develop an electrostatic latent image formed on the photoreceptor 2, a developing bias voltage is applied between a developing sleeve 532 and the photoreceptor 2.

The developing device 5 can be inserted into and removed from the image forming apparatus main body 1. The developing device 5 extends along a depth direction Y.

Note here that the depth direction Y is a direction in which an operation side of the image forming section 30 (in this example, the front of the image forming apparatus 100) and a side of the image forming section 30 opposite to the operation side (in this example, the back of the image forming apparatus 100) face. Further, a first side X1 of the horizontal direction X is the left side as seen from the front, and a second side X2 of the horizontal direction X is the right side as seen from the front. Further, reference sign Z denotes a vertical direction.

The developing device 5 is fitted into the image forming apparatus main body 1 by being inserted into the image forming apparatus main body 1 toward a first side Y1 of the depth direction Y. Further, the developing device 5 is detached from the image forming apparatus main body 1 by being withdrawn from the image forming apparatus main body 1 toward a second side Y2 of the depth direction Y. The developing device 5 is configured such that a supply port 551 (see FIGS. 2 to 6 described below) communicates with an outlet (not illustrated) of the toner cartridge 60 via a replenishing section 61 (see FIG. 3 described below) when the developing device 5 has been fitted into the image forming apparatus main body 1.

The charging device 3 uniformly charges a surface of the photoreceptor 2. The exposure device 4 forms an electrostatic latent image on the surface of the photoreceptor 2 by exposing the surface of the photoreceptor uniformly charged by the charging device 3. The developing device 5 forms a visible image by developing the electrostatic latent image, formed on the surface of the photoreceptor 2 by the exposure device 4, with the developer D, accommodated in a developer tank 51. It should be noted that the developing device 5 will be described in detail later.

The transfer device 11 transfers, onto a recording material P, the toner image formed on the surface of the photoreceptor 2. In this example, the transfer device 11 includes a transfer roller 11*a*. The transfer roller 11*a* forms an unfixed toner image on the recording material P by electrostatically transferring toner image on the photoreceptor 2 onto the recording material P.

The photoreceptor cleaning device 8 includes a cleaning member (specifically, a cleaning blade), and uses the cleaning member to collect, as a waste toner, a residual toner left on the surface of the photoreceptor 2 without being transferred onto the recording material P by the transfer device 11.

The exposure device 4 is configured to cause a light beam (specifically, a laser beam) from a light source section 4*a* including a polygonal mirror to traverse across the surface of the photoreceptor in a main scanning direction (i.e. an axial direction of rotation of the photoreceptor) as the photoreceptor 2 is driven to rotate in a predetermined direction. Specifically, the exposure device 4 causes a light beam modulated on the basis of image data inputted from the image reading device 40 or from an outside source to be emitted from the light source section 4*a*, guides the light beam toward the photoreceptor 2 through mirrors, exposes the photoreceptor 2, which has been uniformly charged by the charging device 3, and thereby forms an electrostatic latent image on the surface of the photoreceptor 2.

The fixing device 12 causes the unfixed toner image transferred onto the recording material P by the transfer device 11 to be fixed on the recording material by heat and pressure. Specifically, the fixing device 12 includes a heat source 12*c* such as a heater, a fixing roller 12*a* that is heated by the heat source 12*c*, and a pressure roller 12*b* that is pressed against the fixing roller 12*a*. The fixing device 12 is configured to, by supplying to, a fixing nip section N in which the pressure roller 12 and the fixing roller 12*a* are pressed against each other, a recording material P on which an unfixed image (specifically, an unfixed toner image) has been formed and passing the recording material P through the fixing nip section N, cause the unfixed image (specifically, the unfixed toner image) to be fixed to the recording material P by heat and pressure in the fixing nip section N.

In forming an image, the image forming apparatus 100 described above uses the charging device 3 to uniformly charge the surface of the photoreceptor 2, uses the exposure device 4 to expose the surface thus uniformly charged of the photoreceptor 2 in accordance with image data (image information), and forms an electrostatic latent image on the photoreceptor 2. The electrostatic latent image formed on the photoreceptor 2 is developed by the developing device 5 to be rendered visible as a toner image. The toner image rendered visible is transferred onto a recording material P by the transfer device 11, to which a bias voltage that is opposite in polarity to the toner T has been applied, so that the toner image is formed on the recording material P. A recording material P conveyed through a path of conveyance S from a paper feed roller 13*a* of the paper feed device 13 is conveyed to the transfer device 11 by a conveying roller 14 and a registration roller 15 in synchronization with the toner image on the photoreceptor 2. Then, the toner image on the photoreceptor 2 is transferred onto the recording material P by the transfer device 11. The toner image transferred onto the recording material P is heated and pressurized by the fixing device 12 and fused onto the recording material P. The recording material P, to which the toner image has been fixed, is ejected out of the image forming apparatus main body 1 by a paper ejection roller 16 onto a catch tray 17. Thus, the image forming process ends.

Further, the path of conveyance S includes an inversion path Sr through which a recording material P being conveyed in an opposite direction by the paper ejection roller is guided toward an upstream side of the registration roller 15 so as to be turned backside front. In forming an image on the back of a recording material P as well as the surface of the recording material P, the image forming apparatus 1 conveys the recording material P in an opposite direction from the paper ejection roller 16 to the inversion path Sr, turns the recording material P backside front, guides the recording material P back to the registration roller 15, and, as in the case of forming an image on the surface of the recording material P, forms and fixes a toner image on the back of the recording material P. Then, the image forming apparatus 1 ejects the recording material P out of the image forming apparatus main body 1 onto the catch tray 17.

Developing Device

Figure 2:
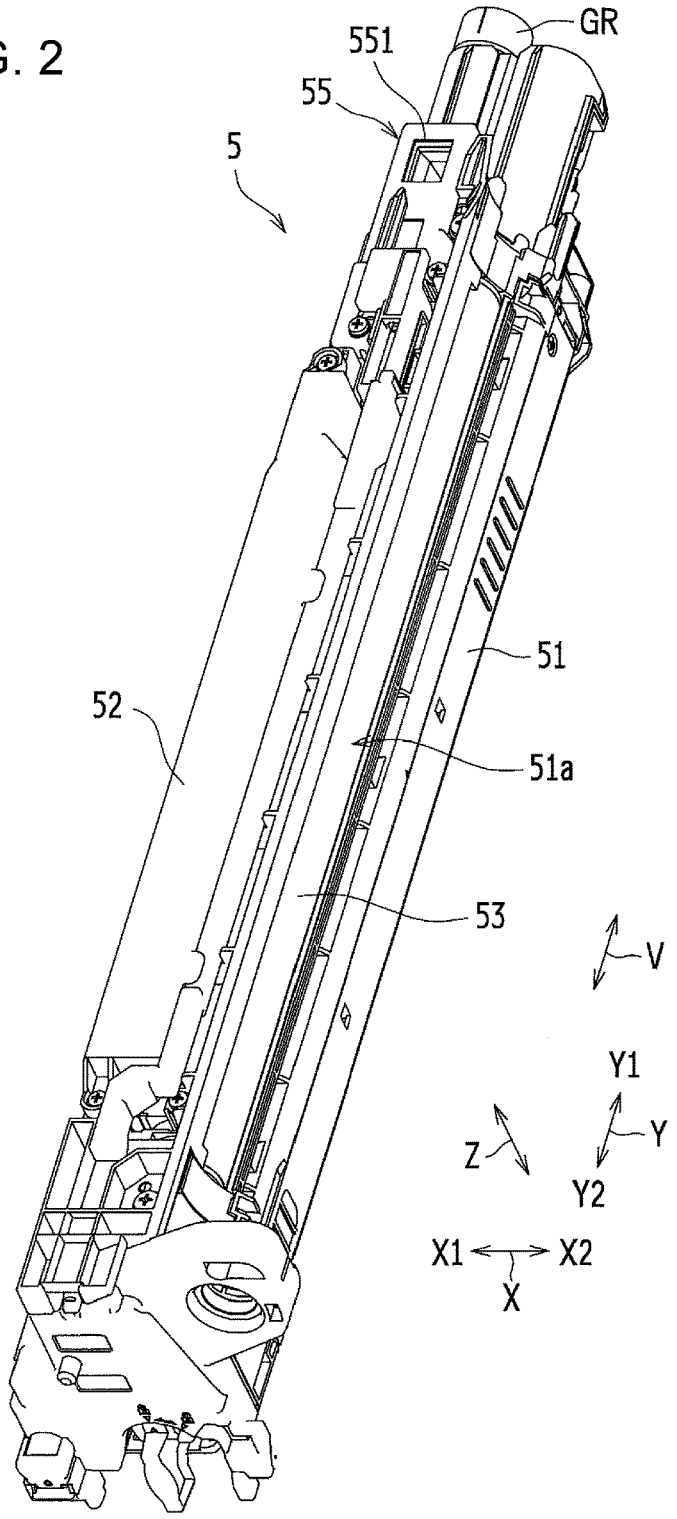
FIG. 2 is a perspective view of the developing device of FIG. 1 as seen obliquely from above the front.
Figure 3:
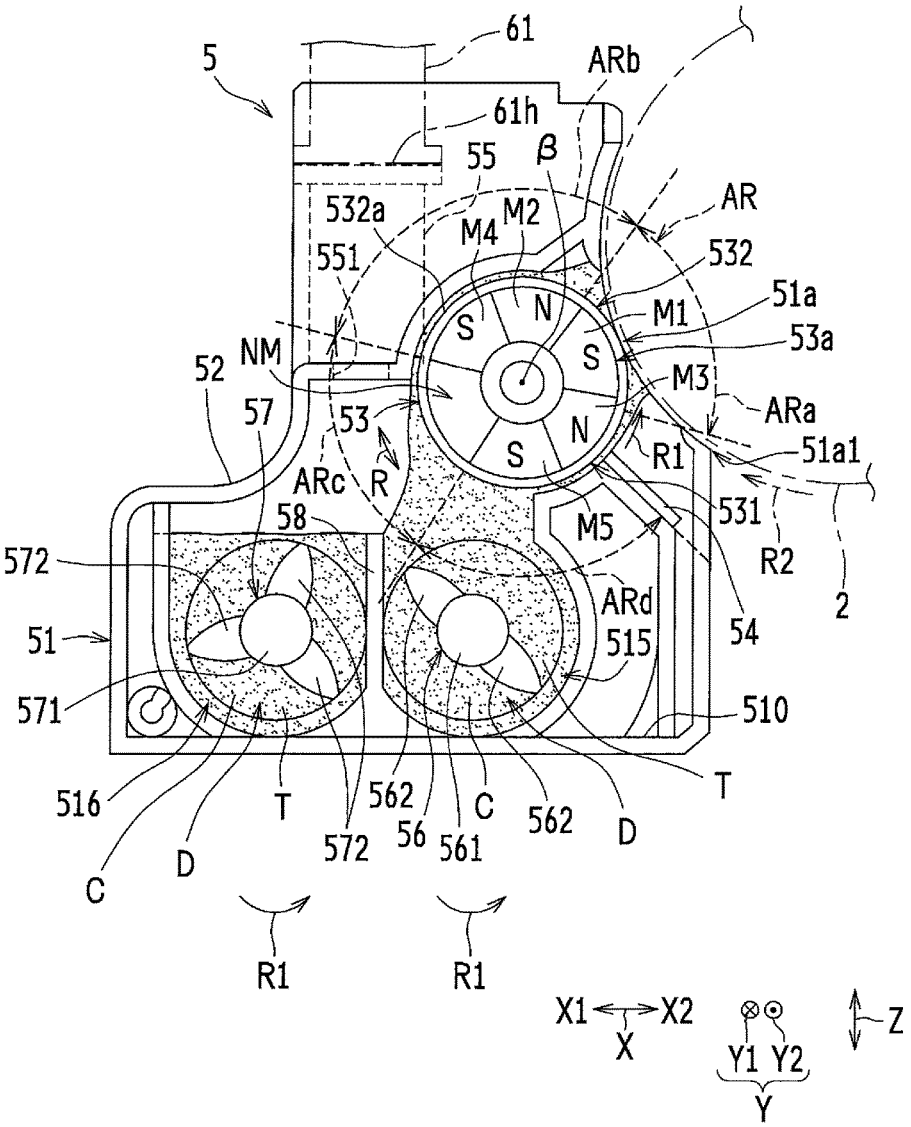
FIG. 3 is a schematic cross-sectional view of the developing device of FIG. 1.
Figure 4:
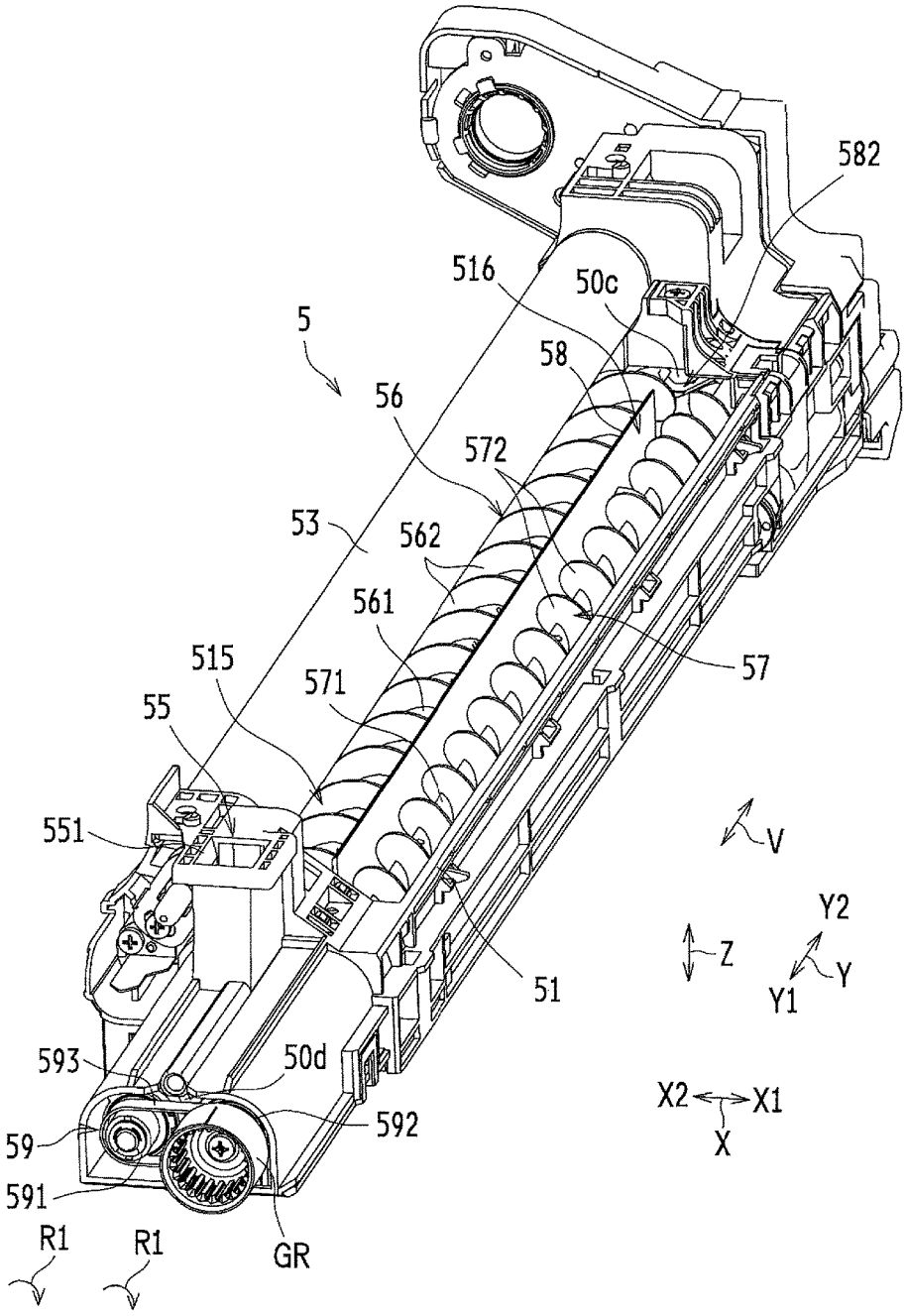
FIG. 4 is a perspective view of the developing device of FIG. 1 as seen obliquely from above the back with a top cover removed from the developing device.
Figure 5:
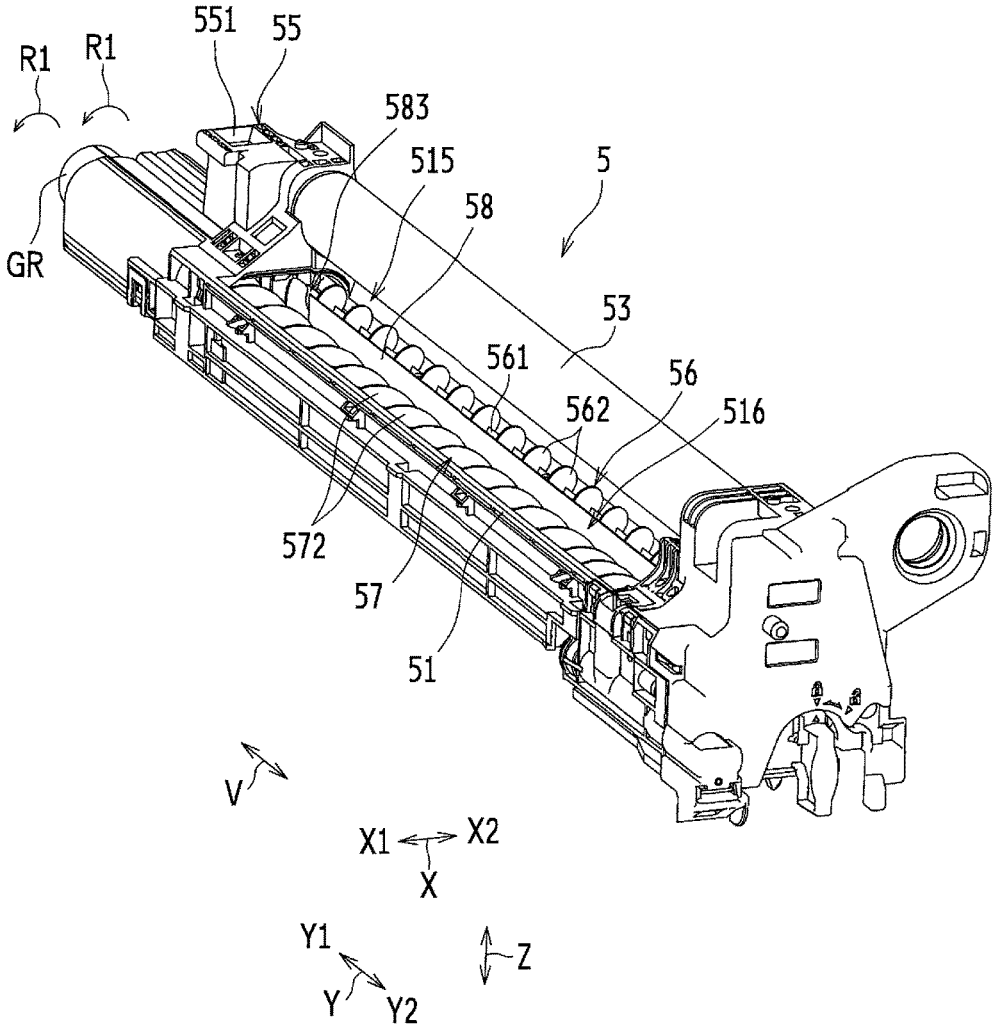
FIG. 5 is a perspective view of the developing device of FIG. 4 as seen obliquely from above the front.
Figure 6:
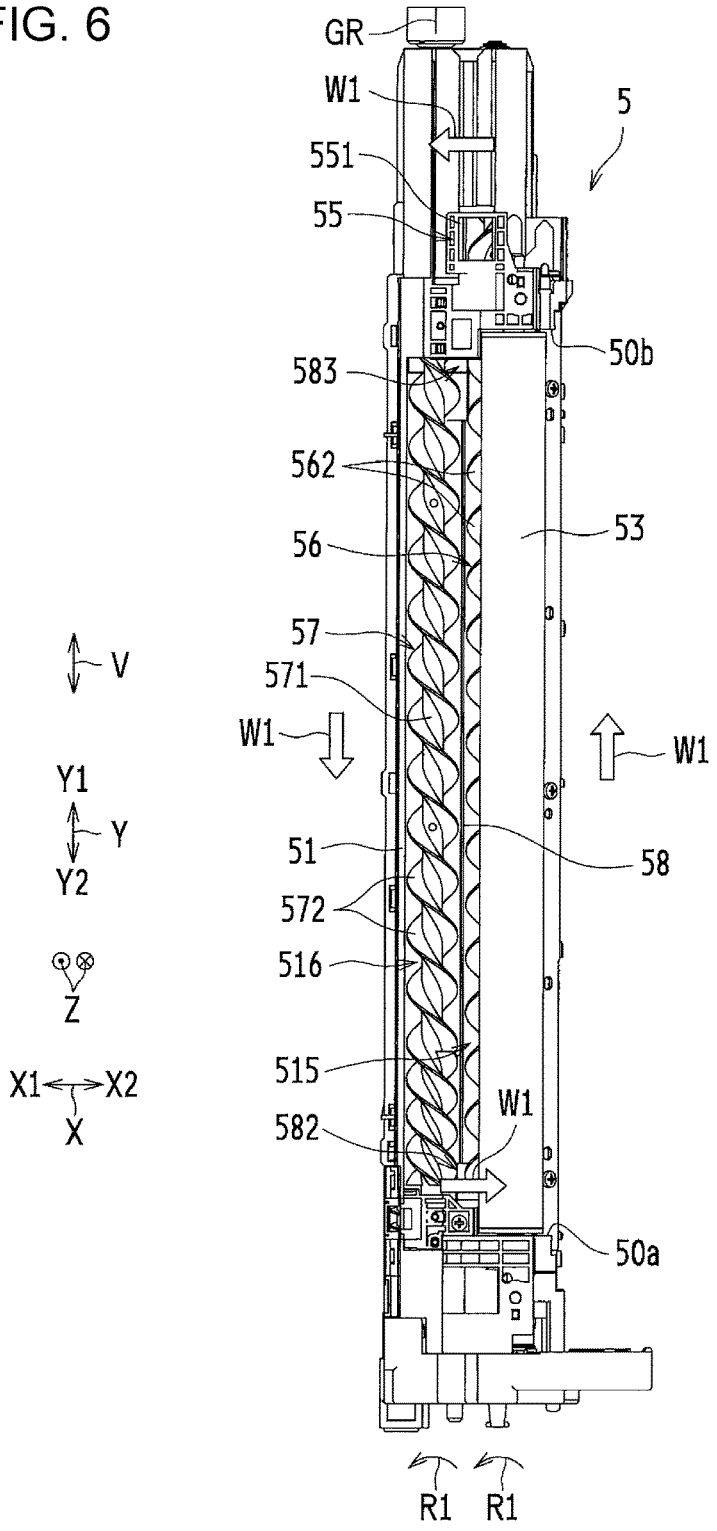
FIG. 6 is a plan view of the developing device of FIG. 4.

FIG. 2 is a perspective view of the developing device 5 of FIG. 1 as seen obliquely from above the front. FIG. 3 is a schematic cross-sectional view of the developing device 5 of FIG. 1. FIG. 4 is a perspective view of the developing device 5 of FIG. 1 as seen obliquely from above the back with a top cover 52 removed from the developing device 5. FIG. 5 is a perspective view of the developing device 5 of FIG. 4 as seen obliquely from above the front. Further, FIG. 6 is a plan view of the developing device 5 of FIG. 4.

It should be noted that FIG. 2 and FIGS. 4 to 6 show a state where the developer D is not accommodated in the developer tank 51. Further, as with FIG. 1, FIGS. 2 to 6 omit to illustrate the toner residue reduction member 500.

The developing device 5 includes a magnet roller 531 (see FIG. 3), the developing sleeve 532 (see FIG. 3), which revolves in a predetermined direction of revolution R1 (see FIG. 3) around the magnet roller 531, the developer tank 51, which has an opening 51*a* (see FIGS. 2 and 3) that forms a development region ARa (a developing bias application region or a substantially developing bias application region) (see FIG. 3) by opening (exposing) a part of a surface 532*a* (see FIG. 3) of the developing sleeve 532 in a circumferential direction R (see FIG. 3), and a regulating member 54 (specifically, a doctor blade [see FIG. 3]) that regulates a layer thickness of the developer D (see FIGS. 1 and 3) on the surface 532*a* of the developing sleeve 532. The developing device 5 uses the developer D to develop an electrostatic latent image formed on the photoreceptor 2 opposed to the opening 51*a* of the developer tank 51. The magnet roller 531 forms a magnetic field on at least part (the whole or part, in this example, part) thereof in the circumferential direction R. The developing sleeve 532 causes the developer D to be adsorbed onto the surface 532*a* by magnetic force while the developing sleeve 531 is revolving in the direction of revolution R1 around the outside of the magnet roller 531. The developer tank 51 accommodates the developer D. The opening 51*a* of the developer tank 51 forms the development region ARa by opening a part of the surface 532*a* of the developing sleeve 532 in the circumferential direction R.

In addition to accommodating the developer D, the developer tank 51 of the developing device 5 accommodates the constituent members of the developing device 5. Normally, the weight ratio of the toner T (see FIGS. 1 and 3) of the developer D in the developer tank 51 is set at about several percent. The toner T and the carrier C (see FIGS. 1 and 3) are mixed together, stirred, and charged in the developer tank 51. The carrier C may take the form of magnetic particles whose surfaces are given electrostatic properties and provided with resin coat layers for reducing the adhesiveness of the toner T. Alternatively, the carrier C may be a resin carrier that takes the form of resin particles with a fine magnetic powder dispersed therein.

Furthermore, the developing device 5 further includes a developing roller 53 (see FIGS. 2 to 6) that acts as a developer support, the regulating member 54, which regulates the layer thickness of the developer D, and an receiving section 55 (see FIGS. 2 to 6) that receives the toner T from the toner cartridge 60 (see FIG. 1).

The developing roller 53 extends along the depth direction Y. The developing roller 53 is disposed in proximity to or in contact with the photoreceptor 2 (see FIGS. 1 and 3). The developing roller 53 includes the magnet roller 531, which has a magnet piece 53*a* (see FIG. 3), and the developing sleeve 532, which takes the form of a cylinder enclosing the magnet roller 531.

The magnet piece 53*a* is constituted by a plurality of magnet bodies M1 to Mn (where n is an integer of 2 or greater, in this example, n=5) (see FIG. The plurality of magnet bodies M1 to Mn are arranged in a radial fashion centered on an axis of revolution β (see FIG. 3) of the developing sleeve 532. In this example, the magnet body M1 is disposed opposite the photoreceptor 2 so that the south pole of the magnet body M1 faces outward, and is located in a central or substantially central part of the development region ARa in the circumferential direction R. The magnet bodies M2 and M3 are disposed at both ends, respectively, of the magnet body M1 so that the north poles of the magnet bodies M2 and M3 face outward. The magnet bodies M4 and M5 are disposed on the sides of the magnet bodies M2 and M3, respectively, opposite to the magnet body M1 so that the south poles of the magnet bodies M4 and M5 face outward.

The magnet roller 531 is irrotatably (fixedly) supported on both side walls 50*a* and 50*b* (see FIG. 6) of the developer tank 51 in the depth direction Y. The developing sleeve 532 is fitted onto the magnet roller 531 and revolvably supported on the side walls 50*a* and 50*b* of the developer tank 51.

The developing roller 53 is configured such that the transmission of rotary drive force from a rotary drive section (not illustrated) to the developing sleeve 532 causes the developing sleeve 532 to revolve in the predetermined direction of revolution R1. This allows the developing roller 53 to supply the developer D to the photoreceptor 2.

Further, the developing roller 53 causes the carrier C of the developer D in the developer tank 51 to be adsorbed onto the developing sleeve 532 of the developing roller 53 by the magnetic force of the magnet roller 531, thereby forming bristles (i.e. a so-called magnetic brush) of the developer D.

The regulating member 54 is provided in the developer tank 51 and has its edge placed at a predetermined spacing from the developing sleeve 532. This allows the regulating member 54 to regulate the layer thickness (i.e. the height of the bristles of the magnetic brush) of the developer D.

In developing an electrostatic latent image formed on the photoreceptor 2 by an image forming operation of the image forming apparatus 100, the developing device 5 thus configured causes the developer D on the developing sleeve 532 to be conveyed toward the photoreceptor 2 by the revolution of the developing sleeve 532 in the direction of revolution R1. The toner T having adhered to the carrier C is supplied to the photoreceptor 2, which rotates in a predetermined direction of rotation R2 (see FIG. 3) opposite to the direction of revolution R1 of the developing sleeve 532, and adsorbed to the electrostatic latent image on the photoreceptor 2. This causes the electrostatic latent image on the photoreceptor 2 to be developed. At this point in time, the toner T of the developer D is consumed, with the result that the toner concentration of the developer D in the developer tank 51 becomes gradually lower. For this reason, a replenishing section 61 (see FIG. 3) that replenishes the developing device 5 with the toner T from the toner cartridge 60 is provided to replenish the developer tank 51 with the toner T through the receiving section 55.

The receiving section 55 has a supply port 551 (see FIGS. 2 to 6) through which the replenishing section 61 replenishes the developer tank 51 with the toner T. The receiving section 55 is configured such that the supply port 551 communicates with a replenishment port 61*h* (see FIG. 3) of the replenishing section 61 when the developing device 5 has been fitted into the image forming apparatus main body 1.

Further, the developing device 5 is configured to circulatorily convey the developer D within the developer tank 51.

Specifically, the developing device 5 further includes screw-shaped members that act as stirring and conveying members (in this example, a first stirring screw [see FIGS. 3 to 6] and a second stirring screw 57 [see FIGS. 3 to 6]) and a dividing wall 58 (see FIGS. 3 to 6) that divides the interior of the developer tank 51 into chambers laid side by side in the horizontal direction X.

The first stirring screw 56 and second stirring screw 57 serve to convey the developer D in the developer tank 51 while stirring it. The first stirring screw 56 and the second stirring screw 57 are each rotatably supported by bearings (not illustrated) on both side walls 50*c* and 50*d* (see FIG. 4) of the developer tank 51 in the depth direction Y.

The firs stirring screw 56 is so disposed in the developer tank 51, slightly below the developing roller 53 (at a predetermined distance), as to be on side of the developing roller 53 opposite to the photoreceptor 2. The first stirring screw 56 has a rotating shaft 561 (see FIGS. 3 to 5) rotatably supported on the side walls 50*c* and 50*d* and a spiral stirring and conveying section 562 (see FIGS. 3 to 6) provided on the rotating shaft 561 and formed to convey the developer D toward the first side Y1 of the depth direction Y by rotating in a predetermined direction of rotation (in this example, the direction of revolution R1 [see FIGS. 3 to 6]).

The second stirring screw 57 is so disposed in the developer tank 51 as to be on a side of the first stirring screw 56 opposite to the photoreceptor 2 in the horizontal direction X. The second stirring screw 57 has a rotating shaft 571 (see FIGS. 3, 4, and 6) rotatably supported on the side walls 50*c* and 50*d* and a spiral stirring and conveying section 572 (see FIGS. 3 to 6) provided on the rotating shaft 571 and formed to convey the developer D toward the second side Y2 of the depth direction Y by rotating in a predetermined direction of rotation (in this example, the direction of revolution R1).

Either of the first and second stirring screws 56 and 57 (in this example, the second stirring screw 57) has a drive transmission member (in this example, a drive gear GR [see FIG. 2 and FIGS. 4 to 6]) provided at an end thereof on the first side Y1 of the depth direction Y.

Further, a drive transmission device 59 (see FIG. 4) is provided to transmit the rotary drive force of the drive transmission member (in this example, the drive gear GR) from either of the first and second stirring screws 56 and 57 (in this example, the second stirring screw 57) the other (in this case, the first stirring screw 56).

In this example, the drive transmission device 59 transmits the rotary drive force of the drive gear GR from the second stirring screw 57 to the first stirring screw 56 so that the first-stirring screw 56 and the second stirring screw 57 rotate in the same direction (specifically, the direction of revolution R1).

Specifically, the drive transmission device 59 includes a first timing pulley 591 (see FIG. 4), a second timing pulley 592 (see FIG. 4), and a timing belt 593 (see FIG. 4). The second timing pulley 592 is provided adjacent to the drive gear GR at an end of the second stirring screw 57 on the first side Y of the depth direction Y and rotates with the rotation of the drive gear GR. The first timing pulley 591 is provided at an end of the first stirring screw 56 on the firs side Y1 of the depth direction Y so as to make a pair with the second timing pulley 592. The timing belt 593 is wound around the first timing pulley 591 and the second timing pulley 592.

It should be noted that the stirring and conveying members are not limited to the screw-shaped members but may be any members that canal stir and convey the developer D.

The dividing wall 58 extends along an axial direction of rotation of the developing roller 53. The dividing wall 58 is a plate-shaped member that extends along the axial direction of rotation of the developing roller 53 and the vertical direction Z. The dividing wall 58 is provided between the first stirring screw 56 and the second stirring screw 57. The dividing wall 58 separates a part of a path of conveyance of the developer by the first stirring screw 56 and the second stirring screw 57 (in this example, a central part of the path of conveyance in the depth direction Y).

Specifically, the dividing wall 58 divides a part of the developer tank in which the developer D is accommodated into a first stirring and conveying chamber 515 (see FIGS. 3 to 6) and a second stirring and conveying chamber 516 (see FIGS. 3 to 6). This allows the developer D to be conveyed by the first stirring screw 56 toward the first side Y1 of the depth direction Y (see an upward conveying direction Y1 shown on the right side of FIG. 6) in the first stirring and conveying chamber 515. This also allows the developer D to be conveyed by the second stirring screw 57 toward the second side Y2 of the depth direction Y (see a downward conveying direction W1 shown on the left side of FIG. 6) in the second stirring and conveying chamber 516.

Further, the developer tank 51 has a first communicating section 582 (see FIGS. 4 and 6) that opens the dividing wall 58 on the second side Y2 of the depth direction Y and a second communicating section 583 (see FIGS. 5 and 6) that opens the dividing wall 58 on the first side Y1 of the depth direction Y. That is, the first stirring and conveying chamber 515 and the second stirring and conveying chamber 516 communicate with each other via the first and second communicating sections 582 and 583 formed at both ends, respectively, of the developer tank 51 in the depth direction Y. This allows the first communicating section 582 to cause the developer D to flow out toward the second side X2 (see a rightward conveying direction W1 show on the lower side of FIG. 6) of the horizontal direction X at the second side Y2 of the depth direction Y This also allows the second communicating section 583 to cause the developer D to flow out toward the first side X1 (see a leftward conveying direction W1 shown on the upper side of FIG. 6) of the horizontal direction X at the first side Y1 of the depth direction Y.

In the developing device 5 described above, the second stirring screw 57 rotates in the direction of revolution R1 when the rotary drive force of the drive gear GR is transmitted in the direction of revolution R1. Furthermore, the rotary drive force of the drive gear GR is transmitted to the first stirring screw 56 via the second timing pulley 592, the timing belt 593, and the first timing pulley 591, so that the first stirring screw 56 rotates in the direction of revolution R1. This causes the developer D to be conveyed toward the first side Y1 of the depth direction Y while being stirred by the rotation of the first stirring screw 56 in the direction of revolution R1. This also causes the developer D to be conveyed toward the second side Y2 of the depth direction Y while being stirred by the rotation of the second stirring screw 57 in the direction of revolution R1. Moreover, as shown in FIG. 6, the developer D arrives in the second stirring and conveying chamber 516 from the first stirring and conveying chamber 515 by being conveyed from the first side Y1 of the depth direction Y toward the first side X1 of the horizontal direction X through the second communicating section 583 and arrives in the first stirring and conveying chamber 515 from the second stirring and conveying chamber 516 by being conveyed from the second side Y2 of the depth direction Y toward the second side X2 of the horizontal direction X through the first communicating section 582. Thus, the developer D is conveyed in such a manner as to circulate from the first stirring and conveying chamber 515 to the second stirring and conveying chamber 516 and vice versa while being stirred in the developer tank 51. Moreover, the developer D in the developer tank 51 is drawn up onto the surface of 532*a* of the developing sleeve 532 by the revolution of the developing sleeve 532 in the direction of revolution R1 and further conveyed toward the photoreceptor 20.

Incidentally, as mentioned above, depending on the composition of the developer D (in this example, the toner T and/or the carrier C), the state of external additives, and/or the properties (e.g. surface material and/or surface treatment) of the surface 532*a* of the developing sleeve 532, the developing device 5 may suffer from a residue of the toner T adhering directly to the surface 532*a* of the developing sleeve 532 due to forces of adhesion such as van der Waals forces, although the toner T is supposed to be released from the surface 532*a* of the developing sleeve 532 by centrifugal force or the like generated by the revolution of the developing sleeve 532 after the end of a developing process. The residue of the toner T adhering directly to the surface 532*a* of the developing sleeve 532 remains with charge generated by the previous image and therefore differs in amount of charge from a portion of the toner T newly drawn up onto the surface 532*a* of the developing sleeve 532 by the next revolution, thus raising fears of inconveniently affecting the next image to be developed.

Furthermore, while the developer D on the surface 532*a* of the developing sleeve 532 is supposed to be replaced with a new developer D every time the developing sleeve 532 revolves, a portion of the toner T remains (stays) in the same place on the surface 532*a* of the developing sleeve 532, and depending on the direction in which the developing bias voltage is applied, the toner T is pressed against the surface 532*a* of the developing sleeve 532, with the result that the toner T may adhere firmly to the surface 532*a* of the developing sleeve 532. Then, the layer of the toner T having adhered to the surface 532*a* of the developing sleeve 532 weakens the magnetic force of the magnet roller 531, lowers the amount of the developer D that is conveyed on the surface 532*a* of the developing sleeve 532, and by extension raises fears of inconveniently inviting shortening of the life of the developing sleeve 532.

It is conceivable that such inconveniences may be obviated, for example, by repeating experiments with slight variations in the composition of the developer (in this example, the toner T and/or the carrier C), the state of external additives, and/or the properties (e.g. surface material and/or surface treatment) of the surface 532*a* of the developing sleeve 532 and thereby finding out such a combination of the composition of the developer D, the state of external additives, and/or the properties of the surface 532*a* of the developing sleeve 532 as to reduce a residue of the toner T adhering directly to the surface 532*a* of the developing sleeve 532. In this case, however, an enormous number of experiments need to be conducted, thus entailing much labor.

In this regard, the developing device 5 is configured in the following manner in order to reduce a residue of the toner T adhering directly to the surface 532*a* of the developing sleeve 532.

Figure 7:
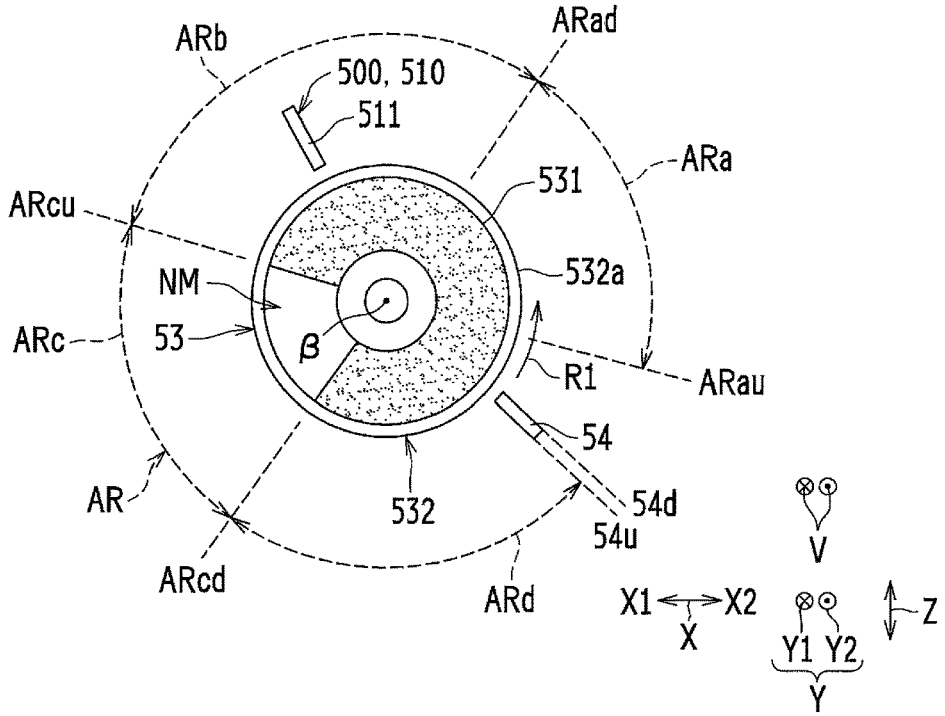
FIG. 7 is a schematic view showing an example of a state of disposition of a toner residue reduction member around a developing sleeve in a developer tank.
Figure 8:
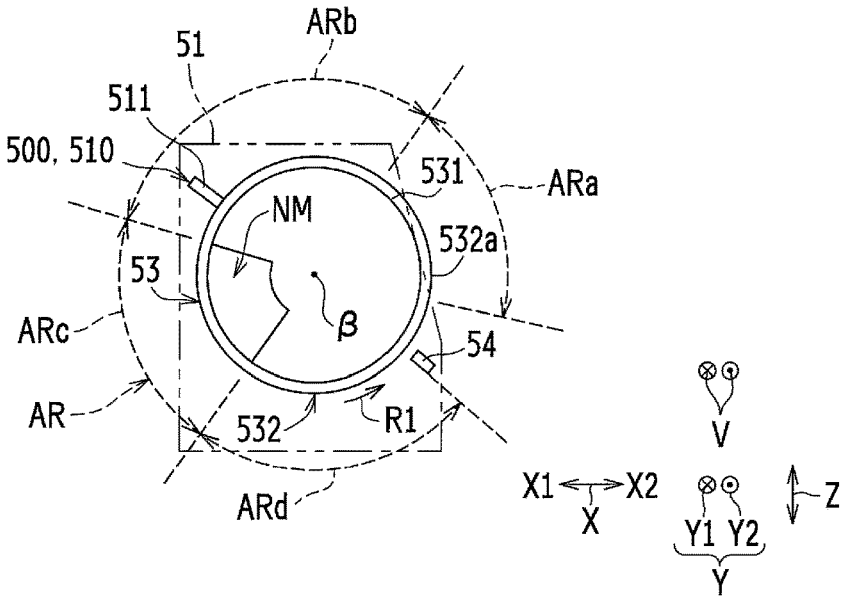
FIG. 8 is a schematic view showing an example of a state where the toner residue reduction member is disposed in an upstream developer retention region.
Figure 9:
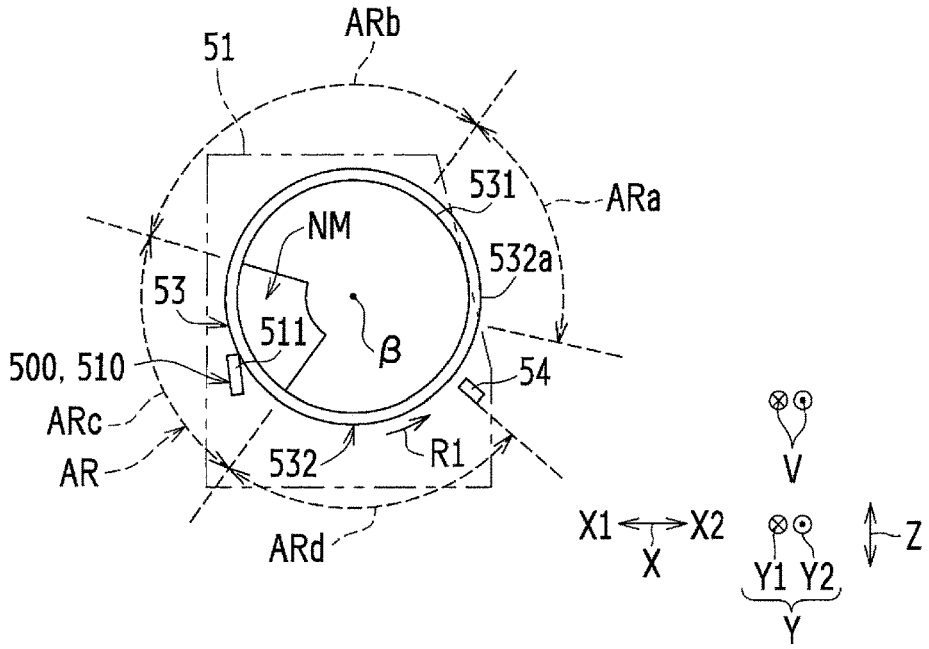
FIG. 9 is a schematic view showing an example of a state where the toner residue reduction member is disposed in a developer release region.
Figure 10:
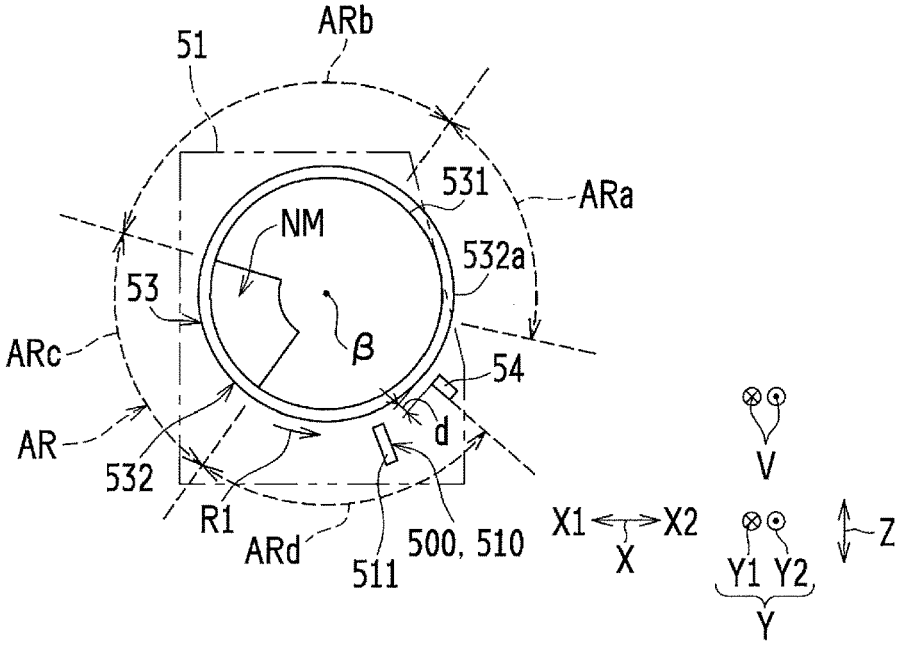
FIG. 10 is a schematic view showing an example of a state where the toner residue reduction member is disposed in a downstream developer retention region.

FIG. 7 is a schematic view snowing an example of a state of disposition of the toner residue reduction member 500 around the developing sleeve 532 in the developer tank 51. FIG. 8 is a schematic view showing an example of a state where the one residue reduction member 500 is disposed in an upstream developer retention region ARb. FIG. 9 is a schematic view showing an example of a state where the toner residue reduction member 500 is disposed in a developer release region ARc. Further, FIG. 10 is a schematic view showing an example of a state where the toner residue reduction member 500 is disposed in a downstream developer retention region ARd. It should be noted that FIG. 7 shows a state where the toner residue reduction member 500 is disposed in the upstream developer retention region ARb. Further, FIGS. 7 to 10 show a state where the developer D is not present on the surface 532*a* of the developing sleeve 532.

The developing device 5 includes the toner residue reduction member 500, which reduces a residue of the toner T adhering directly to the surface 532*a* of the developing sleeve 532.

The present embodiment, which includes the toner residue reduction member 500, makes it possible to, without entailing the labor of conducting an enormous number of experiments, reduce a residue of the toner T adhering directly to the surface 532*a* of the developing sleeve 532. This makes it possible to reduce or eliminate the influence on the next image to be developed and the lowering of the amount of the developer D that is conveyed on the surface 532*a* of the developing sleeve 532 and to reduce the shortening of the life of the developing sleeve 532. Moreover, this also makes it possible to use the toner T with no limitations on the particle diameter, the average degree of circularity, or the like, thus making it possible to avoid rise in cost of usage of the toner T.

Incidentally, the toner residue reduction member 500 hinders the movement of the toner T from the developing sleeve 532 to the photoreceptor 2 when disposed in the development region ARa (see FIG. 3 and FIGS. 7 to 10) of an outer region AR (see FIG. 3 and FIGS. 7 to 10) around the outside of the developing sleeve 532. Further, even if this hindrance is avoided, the state of the developer D (see FIG. 3), whose amount of conveyance and charged state have been optimized by the regulating member 54, may be changed, with the result that the image to be developed is highly likely to be affected.

In this regard, in the present embodiment, the toner residue reduction member 500 may be so disposed in the outer region AR around the outside of the developing sleeve 532 as to be in a region (ARb, ARc, or ARd) (see FIG. 3 and FIGS. 7 to 10) other than the development region ARa.

This makes it possible to avoid a hindrance to the movement of the toner T from the developing sleeve 532 to the photoreceptor 2, thus making it possible to eliminate the influence on the image to be developed.

Regarding First to Third Embodiments

In the present embodiment, the magnet roller 531 may have a magnetic field non-formation section NM (see FIG. 3 and FIGS. 7 to 10) that forms no magnetic field, and may form the developer release region ARc, which releases the developer D in the magnetic field non-formation section NM.

The regulating member 54 may be so disposed in the outer region AR around the outside of the developing sleeve 532 as to be between an upstream end ARau (see FIG. 7) of the development region ARa in the direction of revolution R1 and a downstream end ARcd (see FIG. 7) of the developer release region ARc in the direction of revolution R1. It should be noted that although, in this example, the regulating member 54 is disposed upstream of the upstream end ARau of the development region ARa in the direction of revolution R1, the regulating member 54 may alternatively be disposed in the position of the upstream end ARau of the development region ARa (specifically, the position where a downstream end 54*d* [see FIG. 7] of the regulating member 54 in the direction of revolution R1 coincides or substantially coincides with the upstream end ARau of the development region ARa, i.e. the position of an edge 51*a*1 [see FIG. 3] upstream in the direction of revolution R1 that forms the opening 51*a* of the developer tank 51).

Incidentally, the toner residue reduction member 500 may be disposed in any of the following regions of the outer region AR around the outside of the developing sleeve 532: the upstream developer retention region ARb, which is located between a downstream end ARad (see FIG. 7) of the development region ARa in the direction of revolution R1 and an upstream end ARcu (see FIG. 7) of the developer release region ARc in the direction of revolution R1; the developer release region ARc; and the downstream developer retention region ARd, which is located between the downstream end ARcd of the developer release region ARc in the direction of revolution R1 and the regulating member 54 (specifically, an upstream end 54*u* [see FIG. 7] of the regulating member 54 in the direction of revolution R1). However, the upstream developer retention region ARb, the developer release region. ARc, and the downstream developer retention region ARd differ from one another in action on the developer D on the surface 532*a* of the developing sleeve 532 in a developing process.

First Embodiment

In a first embodiment, as shown in FIGS. 7 and 8, the toner residue reduction member 500 may be disposed in the upstream developer retention region ARb. That is, the toner residue reduction member 500 may be disposed to make contact with the developer D on the surface 532*a* of the developing sleeve 532 and to be at a predetermined clearance from (see FIG. or in contact with (see FIG. 8) the surface 532*a* of the developing sleeve 532.

In the upper developer retention region ARb, the developer D is in a state of being retained on the surface 532*a* of the developing sleeve 532 downstream of the development region ARa and upstream of the developer release region ARc in the direction of revolution R1 by the magnetic field of the magnet roller 531. When, in this state, the developer D is forcibly moved by the toner residue reduction member 500, the developer D thus moved causes the toner T having adhered directly to the surface 532*a* of the developing sleeve 532 to move correspondinaly. This makes it possible to reduce a residue of the toner T adhering directly to the surface 532*a* of the developing sleeve 532. Further, since the upstream developer retention region ARb is located downstream of the development region ARa and upstream of the developer release region ARc in the direction of revolution R1, a disturbance of the developer D on the surface 532*a* of the developing sleeve 532 by the toner residue reduction member 500, if any, exerts no influence on the image.

Therefore, by being disposed in the upstream developer retention region ARb, the toner residue reduction member 500 can move the developer D in such a manner as to make contact with the developer D on the surface 532*a* of the developing sleeve 532 and as to be at a predetermined clearance from or in contact with the surface 532*a* of the developing sleeve 532. Then, the developer D thus moved allows the toner T having adhered directly to the surface 532*a* of the developing sleeve 532 to move correspondingly. This makes it possible to further reduce a residue of the toner T adhering directly to the surface 532*a* of the developing sleeve 532. Moreover, since the upstream developer retention region ARb is located downstream of the development region ARa and upstream of the developer release region ARc in the direction of revolution R1, a disturbance of the developer D on the surface 532*a* of the developing sleeve 532 by the toner residue reduction member 500, if any, exerts no influence on the image.

Second Embodiment

In a second embodiment, as shown in FIG. 9, the toner residue reduction member 500 may be so disposed in the developer release region ARc as to be in contact with the surface 532*a* of the developing sleeve 532.

In the developer release region ARc, the developer D is in a state of having been released from the surface 532*a* of the developing sleeve 532 by the magnetic field non-formation section NM of the magnet roller 531. In this state, the developer D may be forcibly moved by the toner residue reduction member 500; however, in this case, the developer D thus moved hardly causes the toner T having adhered directly to the surface 532*a* of the developing sleeve 532 to move. For this reason, it is desirable that the toner T adhering directly to the surface 532*a* of the developing sleeve 532 be scraped away in the developer release region ARc.

Therefore, by being so disposed in the developer release region ARc as to be in contact with the surface 532*a* of the developing sleeve 532, the toner residue reduction member 500 can scrape away the toner T having adhered directly to the surface 532*a* of the developing sleeve 532. This makes it possible to further reduce a residue of the toner T adhering directly to the surface 532*a* of the developing sleeve 532.

Third Embodiment

In a third embodiment, as shown in FIG. 10, the toner residue reduction member 500 may be so disposed in the downstream developer retention region ARc as to make contact with the developer D on the surface 532*a* of the developing sleeve 532 and as to be at a clearance that is equal to or longer than a distance d (see FIG. 10) between the regulating member 54 and the developing sleeve 532 from the surface 532*a* of the developing sleeve 532.

In the downstream developer retention region ARd, the developer D is in a state of having drawn up onto and being retained on the surface 532*a* of the developing sleeve 532 downstream of the developer release region ARc and upstream of the regulating member 54 in the direction of revolution R1 by the magnetic field of the magnet roller 531. When, in this state, the developer D is forcibly moved by the toner residue reduction member 500, the developer D thus moved causes the toner T adhering directly to the surface 532*a* of the developing sleeve 532 to move correspondingly. This makes it possible to reduce a residue of the toner T adhering directly to the surface 532*a* of the developing sleeve 532. Further, since the downstream developer retention region ARd is located downstream of the developer release region ARc and upstream of the regulating member 54 in the direction of revolution R1, a disturbance of the developer D on the surface 532*a* of the developing sleeve 532 by the toner residue reduction member 500 in a position at the distance d or longer from the surface 532*a* of the developing sleeve 532, if any, exerts little or no influence on the image.

Therefore, by being so disposed in the downstream developer retention region ARd as to make contact with the developer D on the surface 532*a* of the developing sleeve 532 and as to be at the distance d or longer from the surface 532*a* of the developing sleeve 532, the toner residue reduction member 500 can move the developer D in a state where the toner residue reduction member 500 is at the distance d or longer from the surface 532*a* of the developing sleeve 532. Then, the developer D thus moved allows the toner T adhering directly to the surface 532*a* of the developing sleeve 532 to move correspondingly. This makes it possible to further reduce a residue of the toner T adhering directly to the surface 532*a* of the developing sleeve 532. Moreover, since the downstream developer retention region ARd is located downstream of the developer release region ARc and upstream of the regulating member 54 in the direction of revolution R1, a disturbance of the developer D on the surface 532*a* of the developing sleeve 532 by the toner residue reduction member 500, if any, exerts little or no influence on the image.

Regarding First to Third Embodiments

It should be noted that a plurality of the toner residue reduction members 500 may be provided in the first to third embodiments. Possible examples of aspects include an aspect in which one or more toner residue reduction members 500 are provided in at least two of the upstream developer retention region ARb, the developer release region ARc, and the downstream developer retention region ARd and an aspect in which two or more toner residue reduction members 500 are provided in at least one of the upstream developer retention region ARb, the developer release region ARc, and the downstream developer retention region ARd and either no toner residue reduction member 500 or one or more toner residue reduction members 500 are provided in the remaining regions. Alternatively or furthermore, at least two of the first to third embodiments may be combined.

Fourth Embodiment

Developer-moving Member

In a fourth embodiment, according to the first to third embodiments, the toner residue reduction member 500 may include a developer-moving member 510 that moves the developer D in a direction of intersection (e.g. an axial direction of revolution V of the developing sleeve 532) with the direction of revolution R1.

In this way, the developer D moved in the direction of intersection (e.g. the axial direction of revolution V) by the developer-moving member 510 allows the toner T having adhered directly to the surface 532*a* of the developing sleeve 532 to move correspondingly. This makes it possible to further reduce a residue of the toner T adhering directly to the surface 532*a* of the developing sleeve 532. Further, the capability of moving the toner T in the direction of intersection (e.g. the axial direction of revolution V) makes it possible to further reduce the influence on the next image to be developed.

Specifically, the developer-moving member 510 moves the developer D in the direction of intersection (e.g. the axial direction of revolution V) by changing the flow of the developer D in the direction of revolution R1 while making contact with the developer D.

Possible examples of the developer-moving member 510 include developer-moving board for moving the developer D in the direction of intersection (e.g. the axial direction of revolution V) and a spiral member (i.e. a so-called screw member) for moving the developer D in the direction of intersection (e.g. the axial direction of revolution V).

Fifth Embodiment

Configuration of Developer-moving Board

In a fifth embodiment, the developer-moving member 510 may be a developer-moving board 511.

Thus, since the developer-moving member 510 is the developer-moving board 511, the developer D can be certainly moved in the direction of intersection (e.g. the axial direction of revolution V) by a simple configuration.

A possible example here is an aspect in which the developer-moving board 511 is fixed. However, the developer-moving board 511 is not, limited to this example but may reciprocate in the direction of intersection (e.g. the axial direction of revolution V). This makes it possible to further certainly move the developer D in the direction of intersection (e.g. the axial direction of revolution V). It should be noted that the reciprocation of the developer-moving board 511 in the direction of intersection can be achieved by a conventional publicly-known reciprocating mechanism and moving driving section.

Sixth Embodiment

Intersection with Tangent to Developer-moving Board

Figure 11:
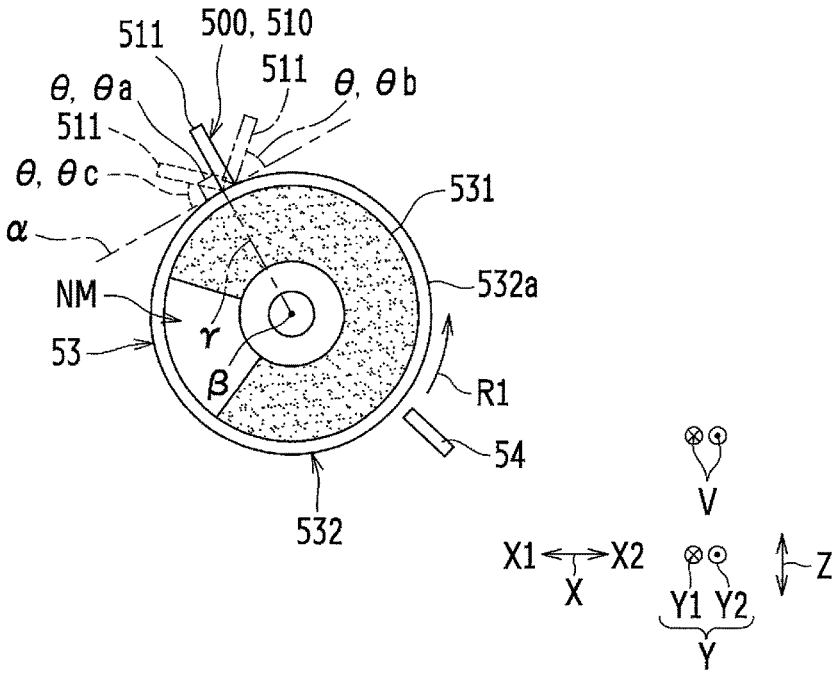
FIG. 11 is a schematic view showing a state where a developer-moving board is disposed to intersect with a tangent to the developing sleeve.

FIG. 11 is a schematic view showing a state where the developer-moving board 511 is disposed to intersect with a tangent α to the developing sleeve 532. It should be noted that although FIG. 11 shows a state where the developer-moving board 511 is disposed to make contact with the developing sleeve 532, the developer-moving board 511 may alternatively be disposed to make contact with the developer D on the surface 532*a* of the developing sleeve 532 and to be at a clearance from the developing sleeve 532.

In the sixth embodiment, as shown in FIG. 11, the developer-moving board 511 may intersect with the tangent α to the developing sleeve 532 (a tangent at a point of contact between the developer-moving board 511 and the developing sleeve 532 or a tangent at a point of contact with a perpendicular γ to the developing sleeve 532 passing through the edge of the developer-moving board 511 and the axis of revolution β) That is, the developer-moving board 511 is disposed at an angle of intersection θ (θa, θb, or θc) with the tangent α to the developing sleeve 532.

This makes it possible to further certainly move the developer D in the direction of intersection (e.g. the axial direction of revolution V).

According to this configuration, in a case where the angle of intersection θ is a right or substantially right angle θa (see a solid line of FIG. 11) or the angle of intersection θ downstream in the direction of revolution R1 is an acute angle θc (see a dashed line of FIG. 11), the developer D can be more effectively moved in the direction of intersection (e.g. the axial direction of revolution V) than in a case where the angle of intersection θ upstream in the direction of revolution R1 is an acute angle θb (see a chain line of FIG. 11). It should be noted that the angles of intersection θ (θa to θc) can be set as appropriate according to the properties, such as fluidity, of the developer D.

Seventh Embodiment

Inclination with Respect to Axis of Revolution of Developer-moving Board.

Figure 12:
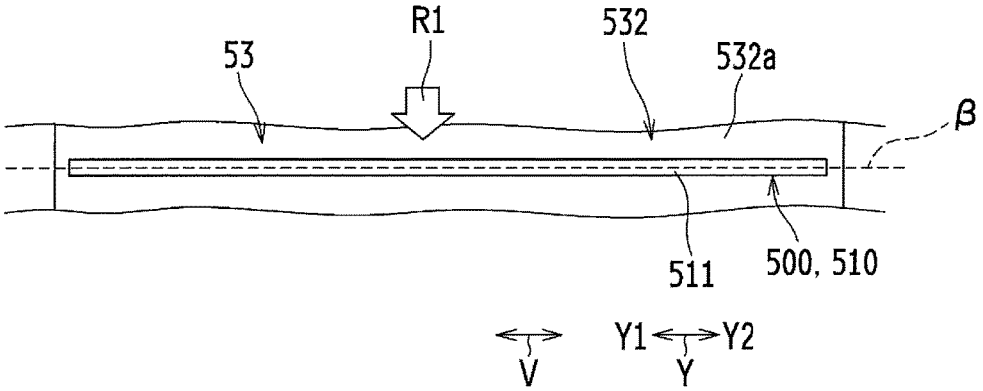
FIG. 12 is a plan view schematically showing a state where the developer-moving board is disposed parallel or substantially parallel to an axis of revolution of the developing sleeve.
Figure 13A:
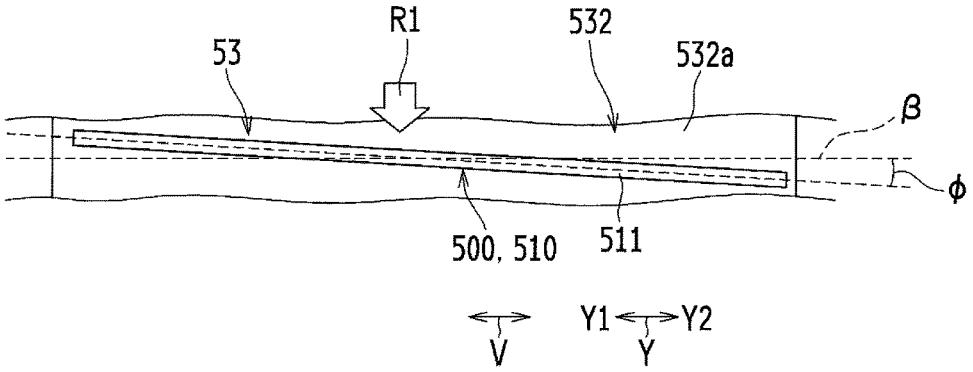
FIGS. 13A and 13B are plan views schematically showing states where the developer-moving board is disposed to be inclined with respect to the axis of revolution of the developing sleeve, FIGS. 13A and 13B being diagrams showing states where the developer-moving board is inclined toward a first side and a second side, respectively.
Figure 13B:
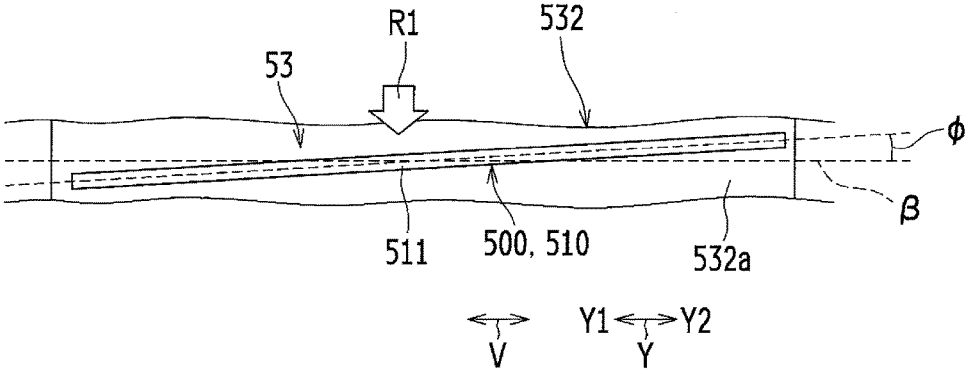

FIG. 12 is a plan view schematically showing a state where the developer-moving board 511 is disposed parallel or substantially parallel to the axis of revolution β of the developing sleeve 532. FIGS. 13A and 13B are plan views schematically showing states where the developer-moving board 511 is disposed to be inclined with respect to the axis of revolution β of the developing sleeve 532. FIGS. 13A and 13B show states where the developer-moving board 511 is inclined toward a first side and a second side, respectively.

It should be noted that although, in the examples shown in FIG. 12 and FIGS. 13A and 13B, the angle of intersection θ (see FIG. 11) of the developer-moving board 511 with the tangent α to the developing sleeve 532 is the right or substantially right angle θa, the angles of intersection θ of the developer-moving board 511 upstream and downstream may be the acute angles θb and θc, respectively. The same applies to FIGS. 14A to 14C to FIG. 24A to 24C described below.

As shown in FIG. 12, the developer-moving board 511 may be parallel or substantially parallel to the axis of revolution β of the developing sleeve 532. In a seventh embodiment, as shown in FIGS. 13A and 13B, the developer-moving board 511 may be inclined with respect to the axis of revolution β of the developing sleeve 532. That is, the developer-moving board 511 may be disposed at an angle of inclination φ with respect to the axis of revolution β of the developing sleeve 532.

Thus, since the developer-moving board 511 is inclined with respect to the axis of revolution β of the developing sleeve 532 (see FIGS. 13A and 13B), the developer D can be more effectively moved toward the first or second side of the direction of intersection than in a case where the developer-moving board 511 is disposed parallel or substantially parallel to the axis of revolution β of the developing sleeve 532 (see FIG. 12). It should be noted that the angle of inclination φ can be set as appropriate according to the properties, such as fluidity, of the developer D.

Eighth Embodiment

Shape of Developer-moving Board

In an eighth embodiment, the developer-moving board 511 may have a predetermined shape (see FIGS. 14A to 24C described below) for moving the developer D in the direction of intersection (e.g. the axial direction of revolution V).

In this way, the predetermined shape of the developer-moving board 511 makes it possible to easily move the developer D in the direction of intersection (e.g. the axial-direction of revolution V).

Developer-moving Board of First Shape

Figure 14A:
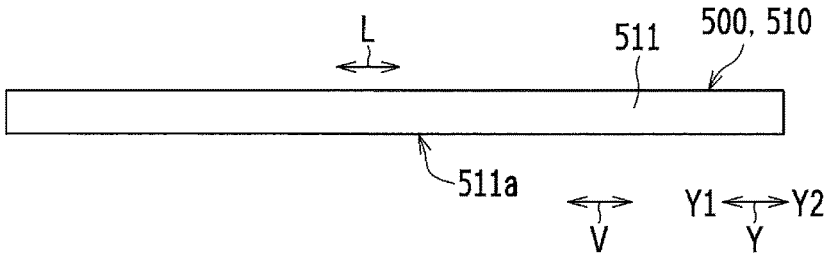
FIGS. 14A to 14C are diagrams for explaining an example of a developer-moving board of a first shape whose opposed section opposed to the developing sleeve has a linear shape, FIG. 14A being a schematic side view of the developer-moving board, FIGS. 14B and 14C being plan views schematically showing states where the developer-moving broad is inclined toward the first side and the second side, respectively.
Figure 14B:
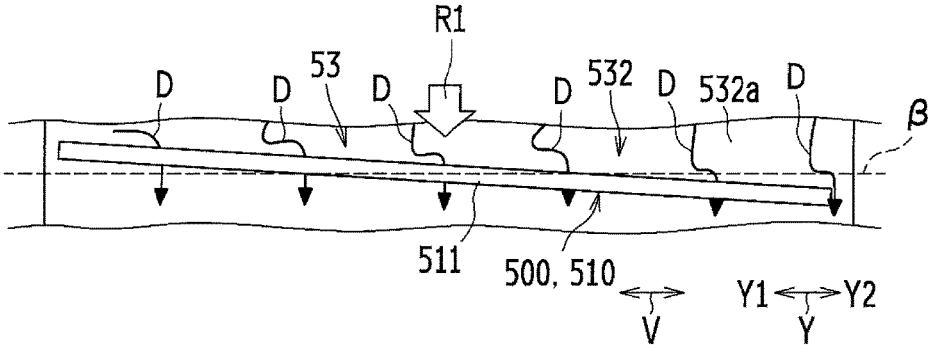
Figure 14C:
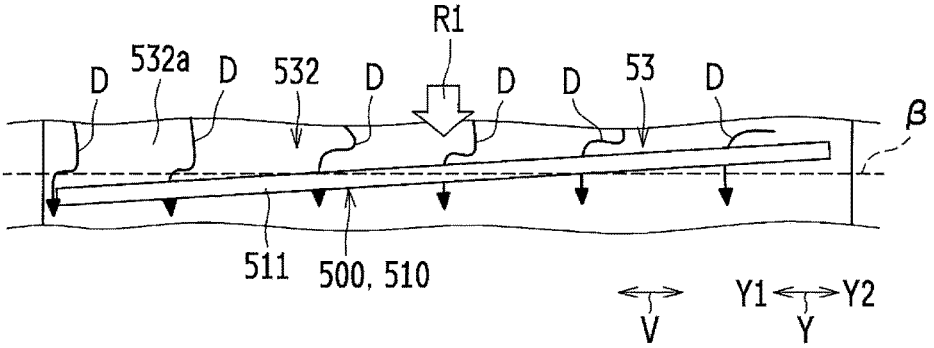

FIGS. 14A to 14C are diagrams for explaining an example of a developer-moving board 511 of a first shape whose opposed section 511*a* opposed to the developing sleeve 532 has a linear shape. FIG. 14A is a schematic side view of the developer-moving board 511. FIGS. 14B and 14C are plan views schematically showing states where the developer-moving board 511 is inclined toward the first side and the second side, respectively.

When the developer-moving board 511 of the first shape is viewed from the side, the opposed section 511*a* (see FIG. 14A) opposed to the developing sleeve 532 has a linear shape.

This allows the developer-moving board 511 to have a simple shape, thus making it possible to simply and easily manufacture the developer-moving board 511.

According to this configuration, the developer D on the surface 532*a* of the developing sleeve 532 changes its flow near an upstream side of the developer-moving board 511 in the direction of revolution R1 and flows along a surface of contact of the developer-moving board 511 with the developer D and, for example, in a case where the developer-moving board 511 is inclined with respect to the axis of revolution β, further flows along the direction of inclination. Furthermore, in a case where the developer-moving board 511 is at a clearance from the developing sleeve 532, the developer D flows in the direction of revolution R1 after passing through the opposed section 511*a* of the developer-moving board 511. Further, in a case where the developer-moving board 511 is in contact with the developing sleeve 532, the developer D flows in the direction of revolution R1 after passing through both outer sides of the developer-moving board 511 in a longitudinal direction L.

According to this configuration, in a case where the developer-moving board 511 is at a clearance from the developing sleeve 532, damage to at least either the developer-moving board 511 or the developing sleeve 532 by contact of the developer-moving board 511 with the developing sleeve 532 can be avoided.

Further, in a case where the developer-moving board 511 is inclined with respect to the axis of revolution β of the developing sleeve 532 (see FIGS. 14B and 14C), the developer D can be more certainly moved toward the first or second side of the direction of intersection than in a case where the developer-moving board 511 is disposed parallel or substantially parallel to the axis of revolution β of the developing sleeve 532.

Specifically, the developer-moving board 511 has a rectangular or substantially rectangular shape as a whole when viewed from the side.

Developer-moving Board of Second Shape

Figure 15A:
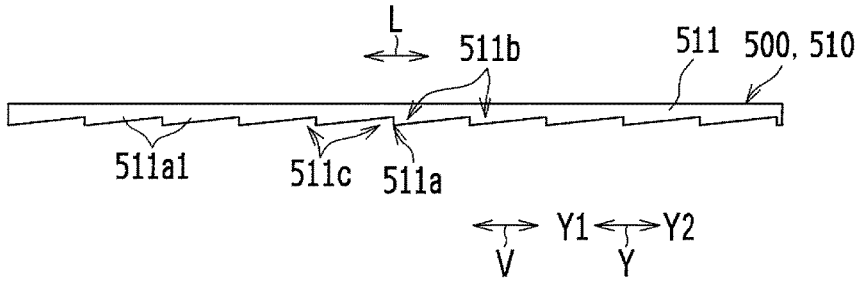
FIGS. 15A to 15C are diagrams for explaining an example of a developer-moving board of a second shape whose opposed section opposed to the developing sleeve has a sawtooth-wave shape, FIG. 15A being a schematic side view of the developer-moving board, FIG. 15B being a view schematically showing a state where the developer-moving board is disposed parallel or substantially parallel to the axis of revolution of the developing sleeve, FIG. 15C being a plan view schematically showing a state where the developer-moving board is inclined toward the first side so that a developer flows in the same direction as that in which the developer-moving board causes the developer to flow.
Figure 15B:
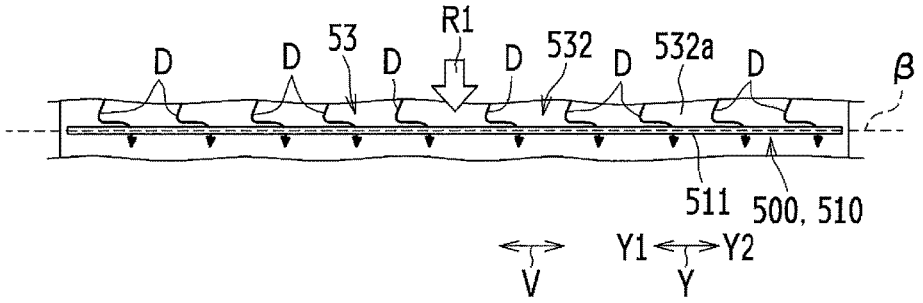
Figure 15C:
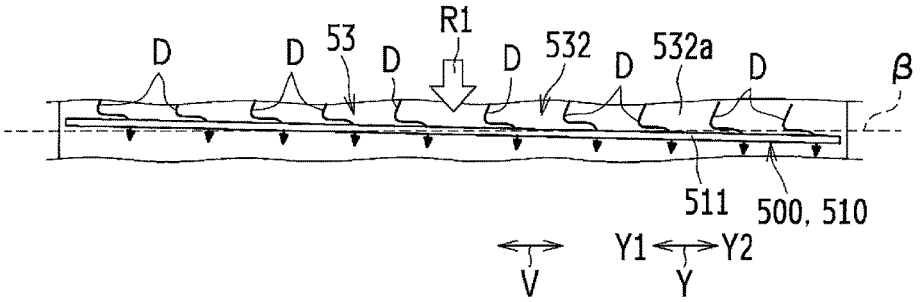
Figure 16A:
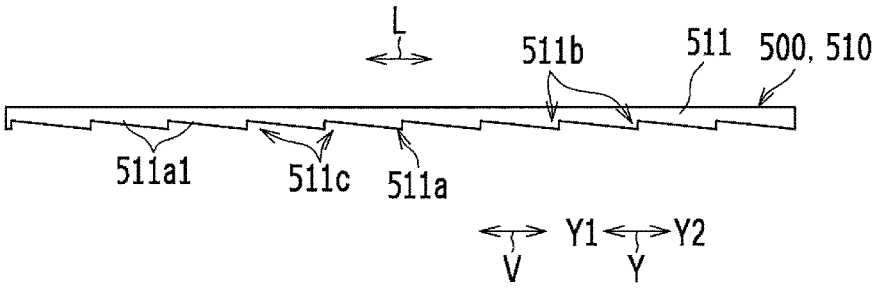
FIGS. 16A to 16C are diagrams for explaining another example of the developer-moving board of the second shape whose opposed section opposed to the developing sleeve has a sawtooth-wave shape, FIG. 16A being a schematic side view of the developer-moving board, FIG. 16B being a plan view schematically showing a state where the developer-moving board is disposed parallel or substantially parallel to the axis of revolution of the developing sleeve, FIG. 16C being a plan view schematically showing a state where the developer-moving board is inclined toward the second side so that the developer flows in the same direction as that in which the developer-moving board causes the developer to flow.
Figure 16B:
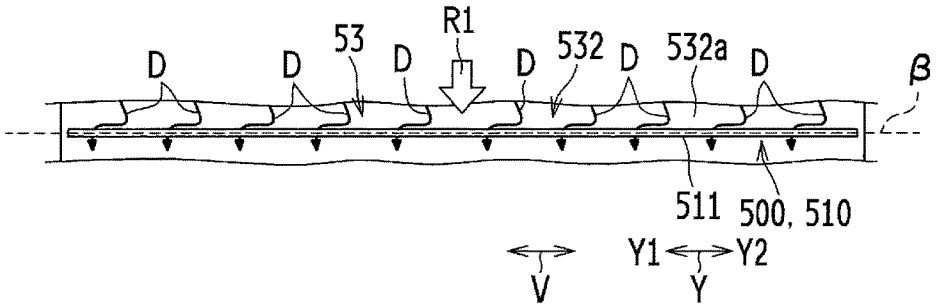
Figure 16C:
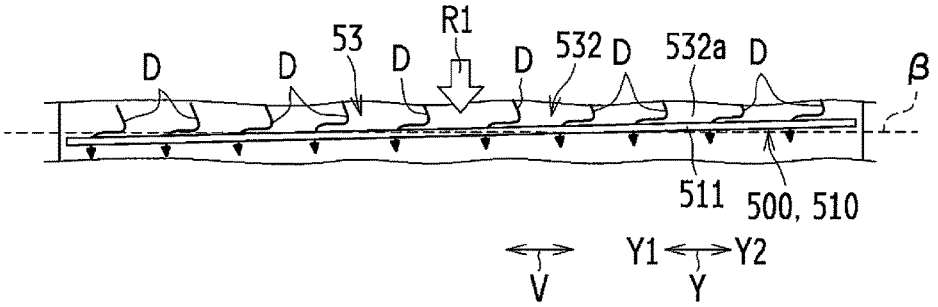
Figure 17A:
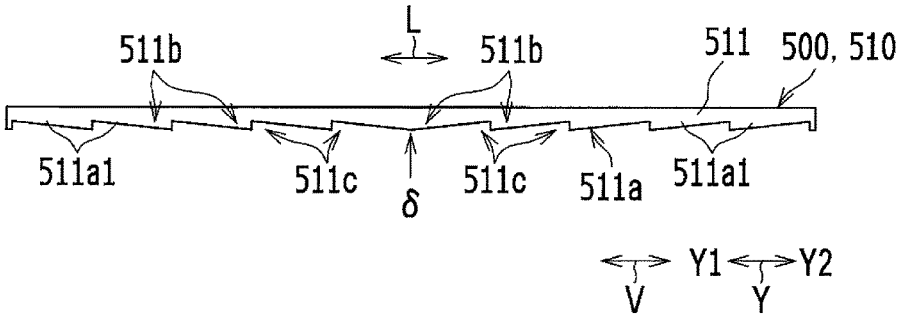
FIGS. 17A and 17B are diagrams for explaining still another example of the developer-moving board of the second shape whose opposed section opposed to the developing sleeve has a sawtooth-wave shape, FIG. 17A being a schematic side view of the developer-moving board, FIG. 17B being a plan view schematically showing a state where the developer-moving board is disposed parallel or substantially parallel to the axis of revolution of the developing sleeve.
Figure 17B:
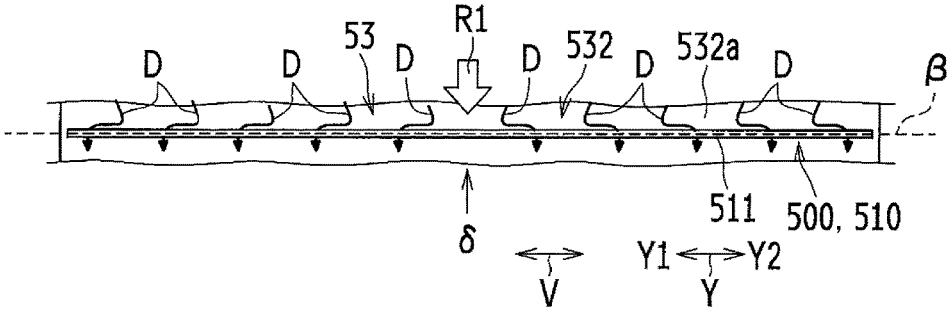

FIGS. 15A to 15C, FIGS. 16A to 16C, and FIGS. 17A and 17C are diagrams for explaining an example, another example, and still another example, respectively, of a developer-moving board 511 of a second shape whose opposed section 511*a* opposed to the developing sleeve 532 has a sawtooth-wave shape. FIG. 15A and 17A are schematic side views of the developer-moving board 511. FIGS. 15B and 17B are plan views schematically showing a state where the developer-moving board 511 is disposed parallel or substantially parallel to the axis of revolution β of the developing sleeve 532. FIGS. 15C and 16C are plan views schematically showing states where the developer-moving board 511 is inclined toward the first side and the second side, respectively, so that the developer D flows in the same direction as that in which the developer-moving board 511 causes the developer D to flow.

When the developer-moving board 511 of the second shape is viewed from the side, the opposed section 511*a* (see FIGS. 15A, 16A, and 17A) opposed to the developing sleeve 532 has a sawtooth-wave shape.

This allows the developer-moving board 511 to have a comparatively simple shape, thus making it possible to simply and easily manufacture the developer-moving board 511 accordingly. This also makes it possible to certainly move the developer D in the direction of intersection (e.g. the axial direction of revolution V).

Note here that the "sawtooth-wave shape" can be formed so that individual sawtooth waves 511*a*1 are identical or substantially identical in shape to one another (see FIGS. 15A, 16A, and 17A). The individual sawtooth waves 511*a*1 can be formed so that the developer D moves toward either (the first side in the example shown in FIGS. 15A to 150 or the second side in the example shown in FIGS. 16A to 16C) of the two sides of the direction of intersection (e.g. the axial direction of revolution V) or can be formed so that the developer D flows toward both inner or outer sides (both outer sides in the example shown in FIGS. 17A and 17B) of the direction of intersection (e.g. the axial direction of revolution Alternatively, in a case where the "sawtooth-wave shape" is formed so that the developer D flows toward both inner or outer sides of the direction of intersection (e.g. the axial direction of revolution V), the individual sawtooth waves 511*a*1 may be shaped so that the individual sawtooth waves 511*a*1 on the first side of the longitudinal direction L and the individual sawtooth waves 511*a*1 on the second side of the longitudinal direction L form mirror images (see FIG. 17A) of each other. In this case, the "sawtooth-wave shape" can for example be bilaterally symmetrical about a central or substantially central part δ (see FIGS. 17A and 17B) in the longitudinal direction L.

According to this configuration, the developer D on the surface 532*a* of the developing sleeve 532 changes its flow near an upstream side of the developer-moving board 511 in the direction of revolution R1 and flows along a direction of inclination of an inclined part of a projecting portion 511*b* of the "sawtooth-wave shape" of the developer-moving board 511 inclined with respect to the direction of revolution R1 and, example, in case where the developer-moving board 511 is inclined with respect to the axis of revolution β as in the case of the configurations shown in FIGS. 15C and 16C, further flows along the direction of inclination Furthermore, in a case where the developer-moving board 511 is at a clearance from the developing sleeve 532, the developer D flows in the direction of revolution R1 after passing through the opposed section 511*a* of the developer-moving board 511. Further, in a case where the developer-moving board 511 is in contact with the developing sleeve 532, the developer D flows in the direction of revolution R1 after passing through a depressed portion 511*c* of the "sawtooth-wave shape" of the opposed section 511*a* of the developer-moving board 511 and further passing through both outer sides of the developer-moving board 511 in the longitudinal direction L.

According to this configuration, in a case where the developer-moving board 511 is at a clearance from the developing sleeve 532, damage to at least either the developer-moving board 511 or the developing sleeve 532 by contact of the developer-moving board 511 with the developing sleeve 532 can be avoided. Further, even in a case where the developer-moving board 511 is in contact with the developing sleeve 532, contact with the developing sleeve 532 can be avoided at the depressed portion 511*c* of the "sawtooth-wave shape", so that damage to at least either the developer-moving board 511 or the developing sleeve 532 by contact of the developer-moving board 511 with the developing sleeve 532 can be reduced accordingly.

Further, in a case where the developer-moving board 511 is inclined with respect to the axis of revolution β of the developing sleeve 532 (see FIGS. 15C and 16C), the developer D can be more certainly moved toward the first or second side of the direction of intersection (e.g. the axial direction of revolution V) than in a case where the developer-moving board 511 is disposed parallel or substantially parallel to the axis of revolution β of the developing sleeve 532.

Developer-moving Board of Third Shape

Figure 18A:
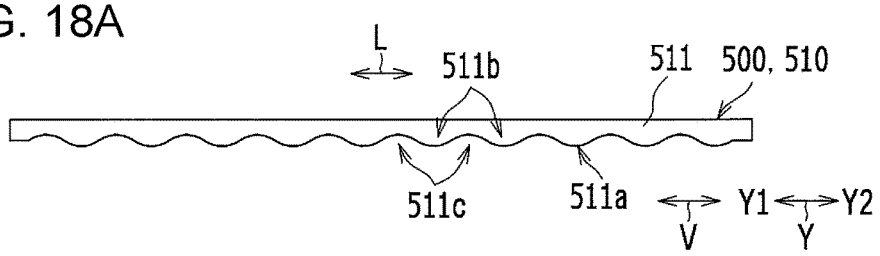
FIGS. 18A to 18D are diagrams for explaining an example of a developer-moving board of a third shape whose opposed section opposed to the developing sleeve has a curved wave shape, FIG. 18A being a schematic side view of the developer-moving board, FIG. 18B being a plan view schematically showing a state where the developer-moving board is disposed parallel or substantially parallel to the axis of revolution of the developing sleeve, FIGS. 18C and 18D being plan views schematically showing states where the developer-moving board is inclined toward the first side and the second side, respectively.
Figure 18B:
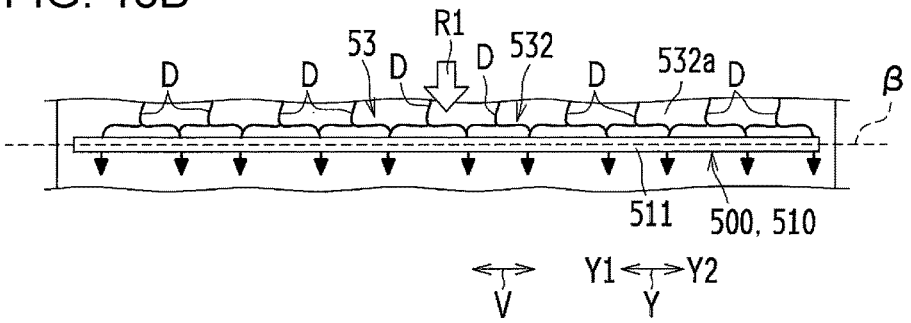
Figure 18C:
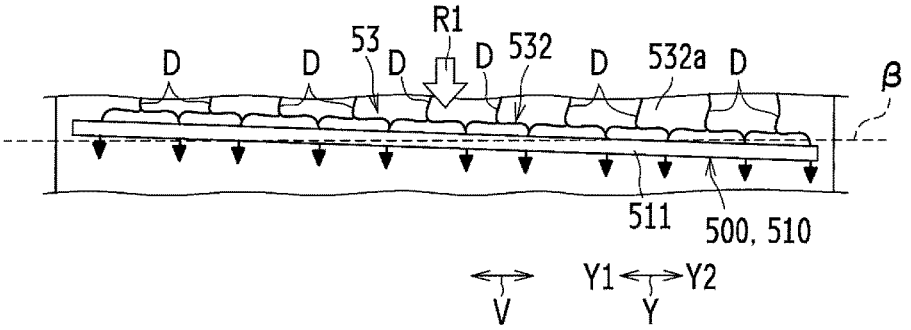
Figure 18D:
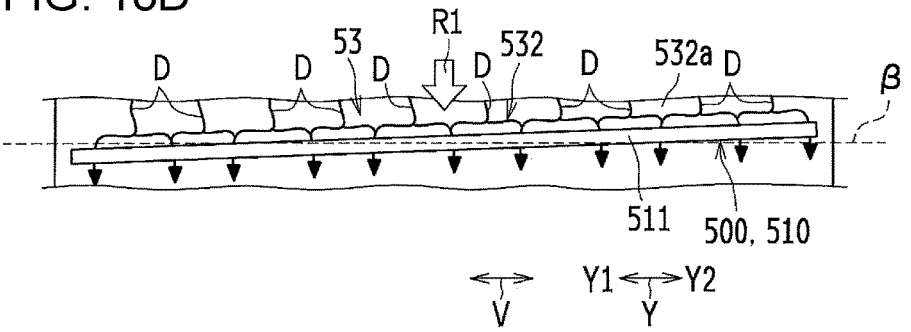

FIGS. 18A to 18D are diagrams for explaining an example of a developer-moving board 511 of a third shape whose opposed section 511*a* opposed to the developing sleeve 532 has a curved wave shape. FIG. 18A is a schematic side view of the developer-moving board. FIG. 18B is a plan view schematically showing a state where the developer-moving board 511 is disposed parallel or substantially parallel to the axis of revolution β of the developing sleeve 532. FIGS. 18C and 18D are plan views schematically showing states where the developer-moving board 511 is inclined toward the first side and the second side, respectively.

When the developer-moving board 511 of the third shape is viewed from the side, the opposed section 511*a* (see FIG. 18A) opposed to the developing sleeve 532 has a curved wave shape (e.g a shape of an alternate arrangement of a plurality of circular arcs differing in orientation from each other or a shape forming sine curves).

This allows the developer-moving board 511 to have a comparatively simple shape, thus making it possible to simply and easily manufacture the developer-moving board 511 accordingly. This also makes it possible to certainly move the developer D in the direction of intersection (e.g. the axial direction of revolution V).

According to this configuration, the developer D on the surface 532*a* of the developing sleeve 532 changes its flow near an upstream side of the developer-moving board 511 in the direction of revolution R1 and flows along a surface of contact of a projecting portion 511*b* of the "curved wave shape" of the developer-moving board 511 with the developer D and, for example, in a case where the developer-moving board 511 is inclined with respect to the axis of revolution β as in the case of the configurations shown in FIGS. 18C and 18D, further flows along the direction of inclination. Furthermore, in a case where the developer-moving board 511 is at a clearance from the developing sleeve 532, the developer D flows in the direction of revolution R1 after passing through the opposed section 511*a* of the developer-moving board 511. Further, in a case where the developer-moving board 511 is in contact with the developing sleeve 532, the developer D flows in the direction of revolution R1 after passing through a depressed portion 511*c* of the "curved wave shape" of the opposed section 511*a* of the developer-moving board 511 and further passing through both outer sides of the developer-moving board 511 in the longitudinal direction L.

According to this configuration, in a case where the developer-moving board 511 is at a clearance from the developing sleeve 532, damage at least either the developer-moving board 511 or the developing sleeve 532 by contact of the developer-moving board 511 with the developing sleeve 532 can be avoided. Further, even in a case where the developer-moving board 511 is in contact with the developing sleeve contact with the developing sleeve 532 can be avoided at the depressed portion 511*c* of the "curved wave shape", so that damage to at least either the developer-moving board 511 or the developing sleeve 532 by contact of the developer-moving board 511 with the developing sleeve 532 can be reduced accordingly.

Further, in a case where the developer-moving board 511 is inclined with respect to the axis of revolution β of the developing sleeve 532 (see FIGS. 18C and 18D), the developer D can be more certainly moved toward the first or second side of the direction of intersection (e.g. the axial direction of revolution V) than in a case where the developer-moving board 511 is disposed parallel or substantially parallel to the axis of revolution β of the developing sleeve 532.

Developer-moving Board of Fourth Shape

Figure 19A:
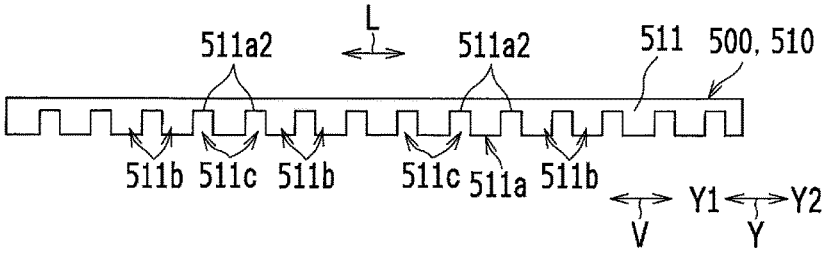
FIGS. 19A to 19D are diagrams for explaining an example of a developer-moving board of a fourth shape whose opposed section opposed to the developing sleeve has a multiple-slit shape, FIG. 19A being a schematic side view of the developer-moving board, 19B being a view schematically showing a state where the developer-moving board is disposed parallel or substantially parallel to the axis of revolution of the developing sleeve, FIGS. 19C and 19D being plan views schematically showing states where the developer-moving board is inclined toward the first side and the second side, respectively.
Figure 19B:
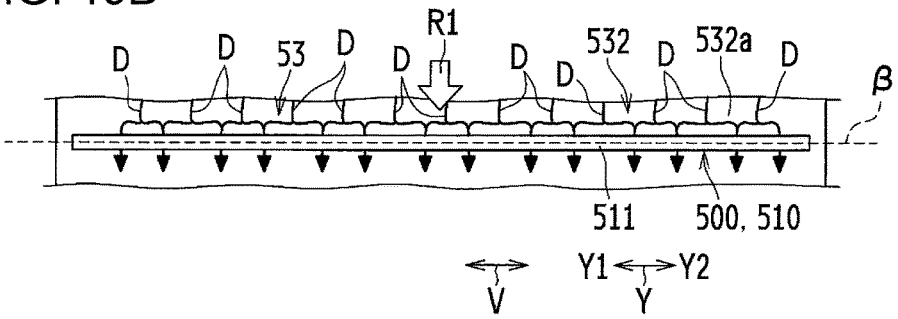
Figure 19C:
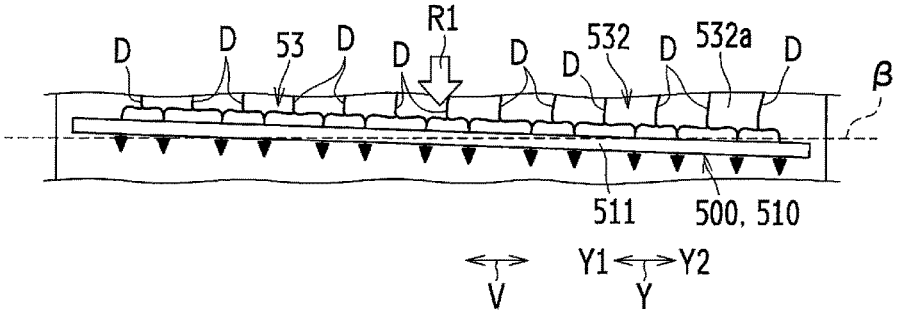
Figure 19D:
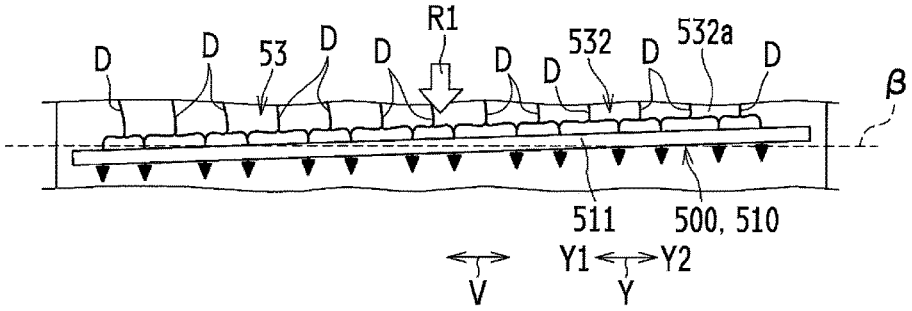
Figure 20A:
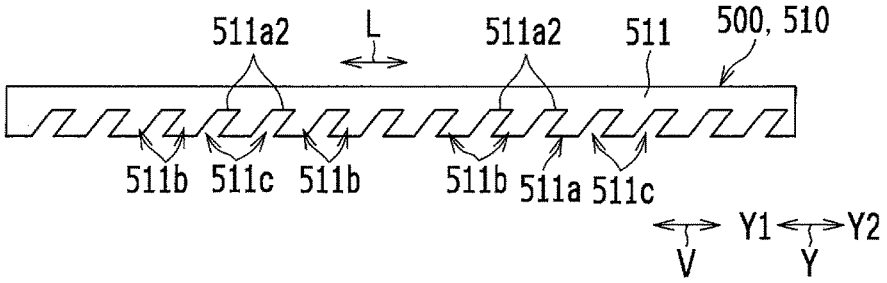
FIGS. 20A to 20C are diagrams for explaining another example of the developer-moving board of the fourth shape whose opposed section opposed to the developing sleeve has a multiple-slit shape, FIG. 20A being a schematic side view of the developer-moving board, FIG. 20B being a plan view schematically showing a state where the developer-moving board is disposed parallel or substantially parallel to the axis of revolution of the developing sleeve, FIG. 20C being a plan view schematically showing a state where the developer-moving board is inclined toward the first side so that the developer flows in the same direction as that in which the developer-moving board causes the developer to flow.
Figure 20B:
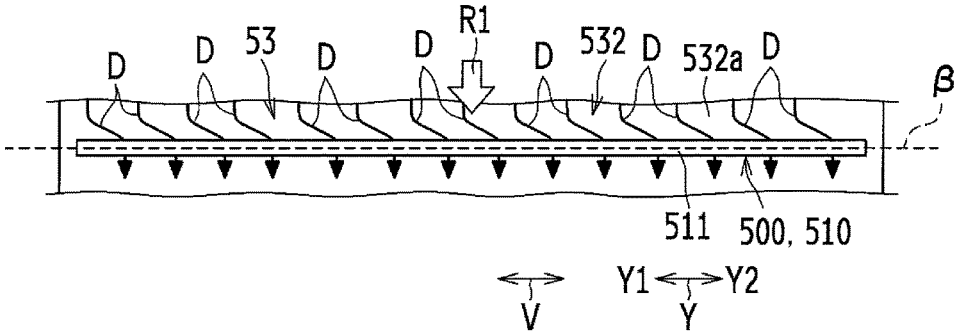
Figure 20C:
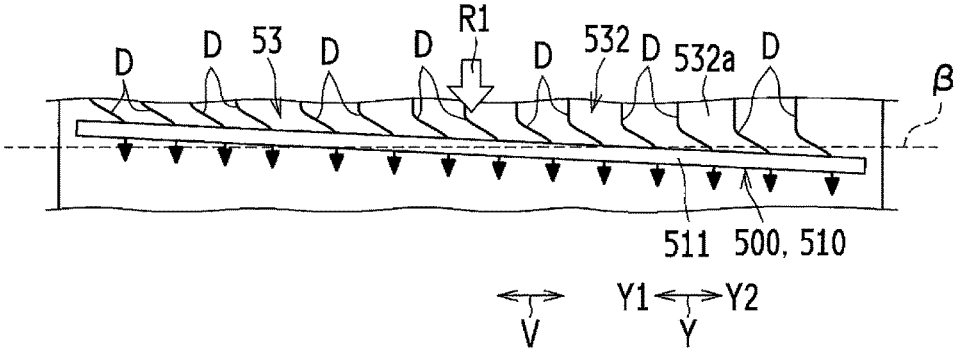
Figure 21A:
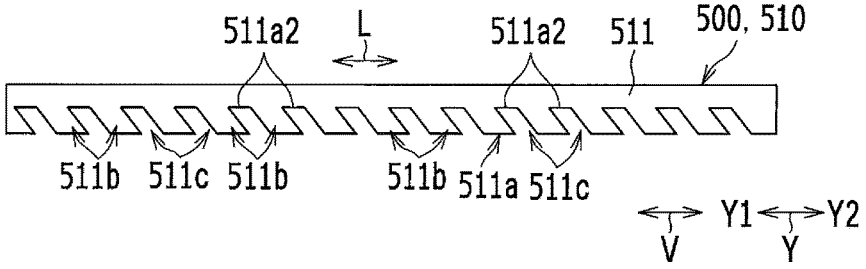
FIGS. 21A to 21C are diagrams for explaining still another example 1 of the developer-moving board of the fourth shape whose opposed section opposed to the developing sleeve has a multiple-slit shape, FIG. 21A being a schematic side view of the developer-moving board, FIG. 21B being a plan view schematically showing a state where the developer-moving board is disposed parallel or substantially parallel to the axis of revolution of the developing sleeve, FIG. 21C being a plan view schematically showing a state where the developer-moving board is inclined toward the second side so that the developer flows in the same direction as that in which the developer-moving board causes the developer to flow.
Figure 21B:
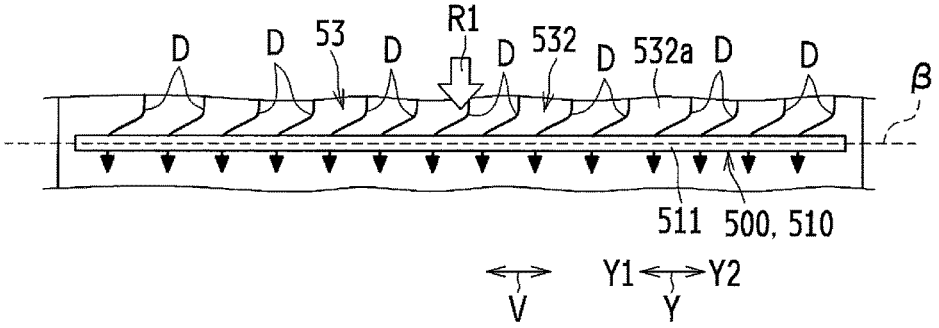
Figure 21C:
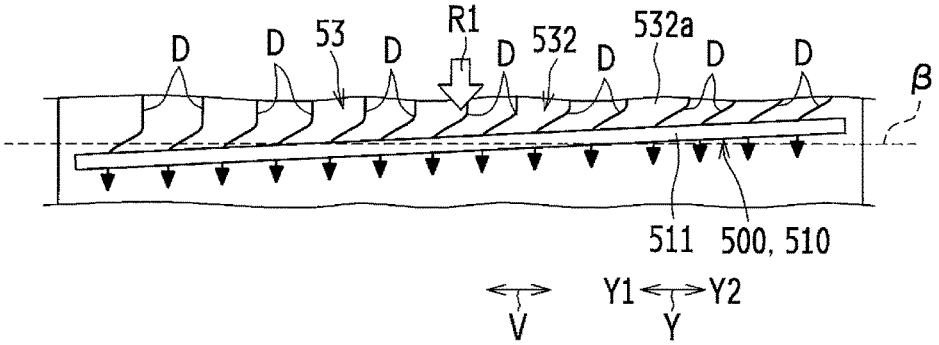
Figure 22A:
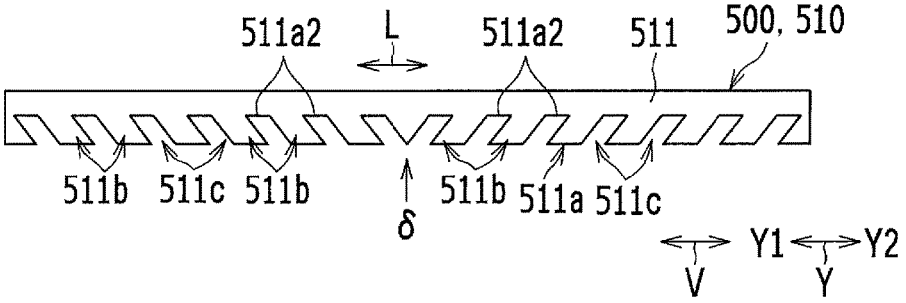
FIGS. 22A and 22B are diagrams for explaining still another example of the developer-moving board of the fourth shape whose opposed section opposed to the developing sleeve has a multiple-slit shape, FIG. 22A being a schematic side view of the developer-moving board, FIG. 22B being a plan view schematically showing a state where the developer-moving board is disposed parallel or substantially parallel to the axis of revolution of the developing sleeve.
Figure 22B:
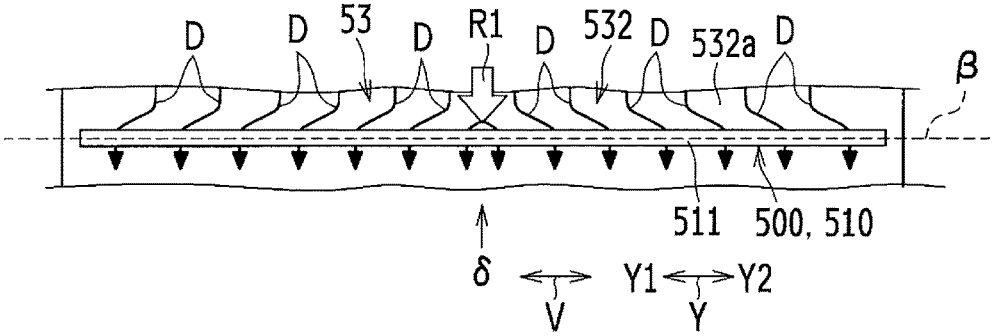

FIGS. 19A to 19D, FIGS. 20A to 20C, FIGS. 21A to 21C, and FIGS. 22A and 22B are diagrams for explaining an example, another example, still another example 1, and still another example 2, respectively, of a developer-moving board 511 of a fourth shape whose opposed section 511*a* opposed to the developing sleeve 532 has a multiple-slit shape. FIGS. 19A, 20A, 21A, and 22A are schematic side views of the developer-moving board 511. FIGS. 19B, 20B, 21B, and 22B are plan views schematically showing a state where the developer-moving board 511 is disposed parallel or substantially parallel to the axis of revolution β of the developing sleeve 532. FIGS. 19C and 19D are plan views schematically showing states where the developer-moving board 511 is inclined toward the first side and the second side, respectively. FIGS. 20C and 21C are plan views schematically showing states where the developer-moving board 511 is inclined toward the first side and the second side, respectively, so that the developer D flows in the same direction as that in which the developer-moving board 511 causes the developer D to flow.

When the developer-moving board 511 of the fourth shape is viewed from the side, the opposed section 511*a* (see FIGS. 19A, 20A, 21A, and 22A) opposed to the developing sleeve 532 has a multiple-slit shape (e.g. a rectangular wave shape).

This allows the developer-moving board 511 to have a comparatively simple shape, thus making it possible to simply and easily manufacture the developer-moving board 511 accordingly. This also makes it possible to certainly move the developer D in the direction of intersection (e.g. the axial direction of revolution V).

Note here that the "slit shape" can be formed so that individual slits 511*a*2 are identical or substantially identical in shape to one another (see FIGS. 19A, 20A, 21A, and 22A). The individual slits 511*a*2 can be formed to extend along the direction of revolution R1 (see FIG. 19A) or can be formed to be inclined with respect to the direction of revolution R1 (see FIGS. 20A to 22B). In a case where the individual slits 511*a*2 are formed to inclined with respect to the direction of revolution R1, the individual slits 511*a*2 can be formed so that the developer D moves toward either (the first side in the example shown in FIGS. 20A to 20C or the second side in the example shown in FIGS. 21A to 21C) of the two sides of the direction of intersection (e.g. the axial direction of revolution V) or can be formed so that the developer D flows toward both inner or outer sides (both outer sides in the example shown in FIGS. 22A and 22B) of the direction of intersection (e.g. the axial direction of revolution V). Alternatively, in a case where the "slit shape" is formed so that the developer D flows toward both inner or outer sides of the direction of intersection (e.g. the axial direction of revolution V), the individual slits 511*a*2 may be shaped so that the individual slits 511*a*2 on the first side of the longitudinal direction L and the individual slits 511*a*2 on the second side of the longitudinal direction L form mirror images (see FIG. 22A) of each other. In this case, the "slit shape" can for example be bilaterally symmetrical about central or substantially central part δ (see FIGS. 22A and 22B) in the longitudinal direction L.

According to the configuration shown in FIGS. 19A to 19D, the developer D on the surface 532*a* of the developing sleeve 532 changes its flow near an upstream side of the developer-moving board 511 in the direction of revolution R1 and flows along a surface of contact of a projecting portion 511*b* of the "slit shape" of the developer-moving board 511 with the developer D and, for example, in a case where the developer-moving board 511 is inclined with respect to the axis of revolution β as in the case of the configurations shown in FIGS. 19C or 19D, further flows along the direction of inclination.

Further, according to the configurations shown in FIGS. 20A to 22B, the developer D on the surface 532*a* of the developing sleeve 532 changes its flow near an upstream side of the developer-moving board 511 in the direction of revolution R1 and flows along a direction of inclination of an inclined part of a projecting portion 511*b* of the "slit shape" of the developer-moving board 511 inclined with respect to the direction of revolution R1 and, for example, in a case where the developer-moving board 511 is inclined with respect to the axis of revolution β as in the case of the configurations shown in FIGS. 20C and 21C, further flows along the direction of inclination.

Furthermore, according to the configurations shown in FIGS. 19A to 22B, in a case where the developer-moving board 511 is at a clearance from the developing sleeve 532, the developer D flows in the direction of revolution R1 after passing through the opposed section 511*a* of the developer-moving board 511. Further, in a case where the developer-moving board 511 is in contact with the developing sleeve 532, the developer D flows in the direction of revolution R1 after passing through a depressed portion 511*c* of the "slit shape" of the opposed section 511*a* of the developer-moving board 511 and further passing through both outer sides of the developer-moving board 511 in the longitudinal direction L.

According to this configuration, in a case where the developer-moving board 511 is at a clearance from the developing sleeve 532, damage to at least either the developer-moving board 511 or the developing sleeve 532 by contact of the developer-moving board 511 with the developing sleeve 532 can be avoided. Further, even in a case where the developer-moving board 511 is in contact with the developing sleeve 532, contact with the developing sleeve 532 can be avoided at the depressed portion 511*c* of the "slit shape", so that damage to at least either the developer-moving board 511 or the developing sleeve 532 by contact of the developer-moving board 511 with the developing sleeve 532 can be reduced accordingly.

Further, in a case where the developer-moving board 511 is inclined with respect to the axis of revolution β of the developing sleeve 532 (see FIGS. 19C, 19D, 20C, and 21C), the developer D can be more certainly moved toward the first or second side of the direction of intersection (e.g. the axial direction of revolution V) than in a case where the developer-moving board 511 is disposed parallel or substantially parallel to the axis of revolution β of the developing sleeve 532.

Developer-moving Board of Fifth Shape

Figure 23A:
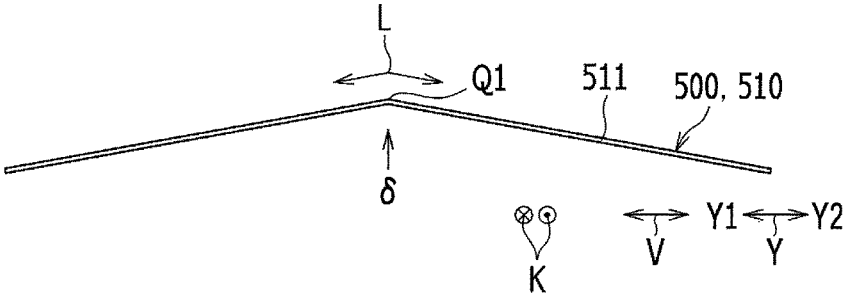
FIGS. 23A to 23C are diagrams for explaining an example of a developer-moving board of a fifth shape which has a V or substantially V shape, FIG. 23A being a schematic plan view of the developer-moving board, FIG. 23B being a plan view schematically showing a state where the developer-moving board is disposed so that virtual straight line connecting both ends of the developer-moving board in a longitudinal direction is parallel or substantially parallel to the axis of revolution of the developing sleeve, FIG. 23C being a perspective view of the developer-moving board.
Figure 23B:
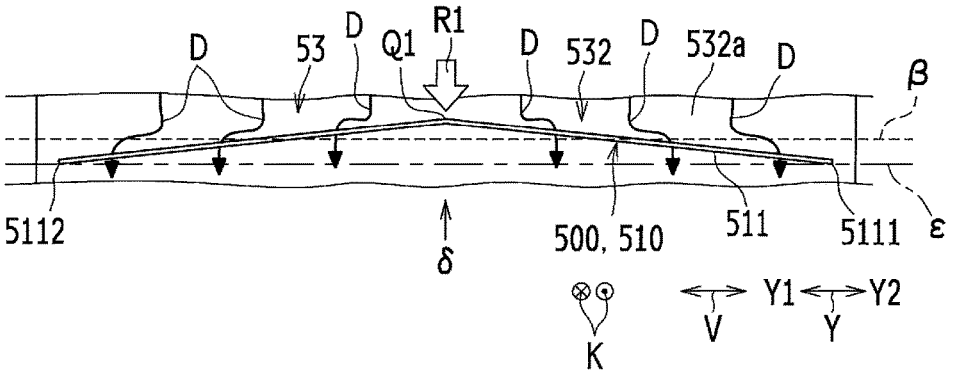
Figure 23C:
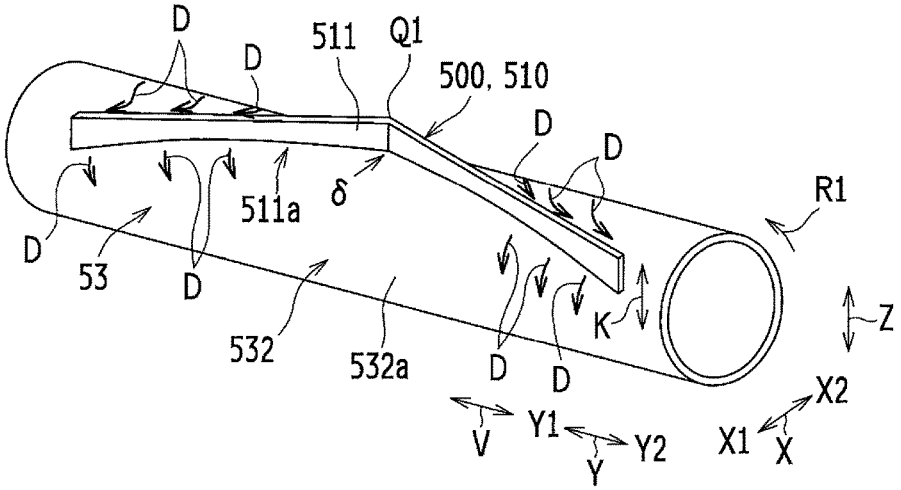

FIGS. 23A to 23C are diagrams for explaining an example of a developer-moving board 511 of a fifth shape which has a V or substantially V shape. FIG. 23A is a schematic plan view of the developer-moving board 511. FIG. 23B is a plan view schematically showing a state where the developer-moving board 511 is disposed so that a virtual straight line ε connecting both ends 5111 and 5112 of the developer-moving board 511 in the longitudinal direction L is parallel or substantially parallel to the axis of revolution β of the developing sleeve 532. FIG. 23C is a perspective view of the developer-moving board 511. It should be noted that FIGS. 23A to 23C show a state where the developer-moving board 511 is at a clearance from the developing sleeve 532.

The developer-moving board 511 of the fifth shape has a V or substantially V shape when viewed in a radial direction of the developing sleeve 532.

This allows the developer-moving board 511 to have a comparatively simple shape, thus making it possible to simply and easily manufacture the developer-moving board 511 accordingly. This also makes it possible to certainly move the developer D in the direction of intersection (e.g. the axial direction of revolution V).

Note here that the developer-moving board 511 of the V or substantially shape is disposed to project upstream in the direction of revolution R1.

According to this configuration, the developer D on the surface 532*a* of the developing sleeve 532 changes its flow near an upstream side of the developer-moving board 511 in the direction of revolution R1 and, at the vertex Q1 of the V or substantially V shape, starts to flow toward two sides along a surface of contact of the developer-moving board 511 with the developer D. Furthermore, in a case where the developer-moving board 511 is at a clearance from the developing sleeve 532, the developer D flows in the direction of revolution R1 after passing through the opposed section 511*a* of the developer-moving board 511. Further, in a case where the developer-moving board 511 is in contact with the developing sleeve 532, the developer D flows in the direction of revolution R1 after passing through both outer sides of the developer-moving board 511 in the longitudinal direction L.

According to this configuration, in a case where the developer-moving board 511 is at a clearance from the developing sleeve 532, damage to at least either the developer-moving board 511 or the developing sleeve 532 by contact of the developer-moving board 511 with the developing sleeve 532 can be avoided.

Further, in a case where the developer-moving board 511 is disposed so that the virtual straight line e connecting both ends 5111 and 5112 of the developer-moving board 511 in the longitudinal direction I is parallel or substantially parallel to the axis of revolution β of the developing sleeve 532 (see FIG. 23B), the virtual straight line ε allows the developer D to more certainly move toward the two sides of the direction of intersection (e.g. the axial direction of revolution V) (e.g. toward the two sides opposite to each other across the central or substantially central part δ in the direction of intersection in a case where the vertex Q1 of the V or substantially V shape located at the central or substantially central part δ in the direction of intersection).

Specifically, the developer-moving board 511 is configured such that board having a rectangular or substantially rectangular shape as a whole when viewed from the side is bent at a fold (vertex Q1) extending along a transverse direction K.

It should be noted that the developer-moving board 511 of the fifth shape may be combined with any one of the second to fourth shapes.

Developer-moving Board of Sixth Shape

Figure 24A:
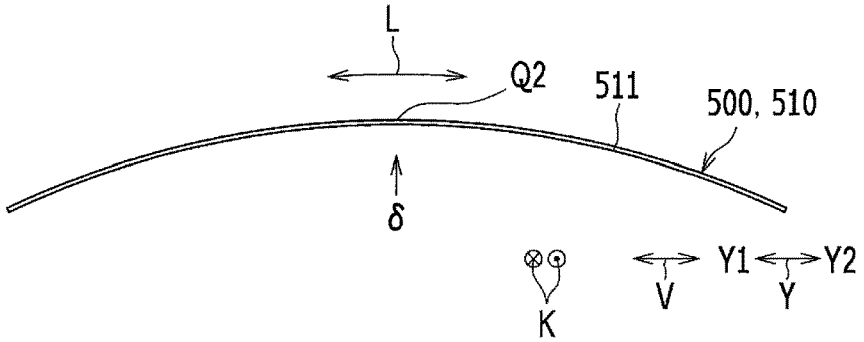
FIGS. 24A to 24C are diagrams for explaining an example of a developer-moving board of a sixth shape which has a U or substantially U shape, FIG. 24A being a schematic plan. view of the developer-moving board, FIG. 24B being a plan view schematically showing a state where the developer-moving board is disposed so that a virtual straight line connecting both ends of the developer-moving board in a longitudinal direction is parallel or substantially parallel to the axis of revolution of the developing sleeve, FIG. 24C being a perspective view of the developer-moving board.
Figure 24B:
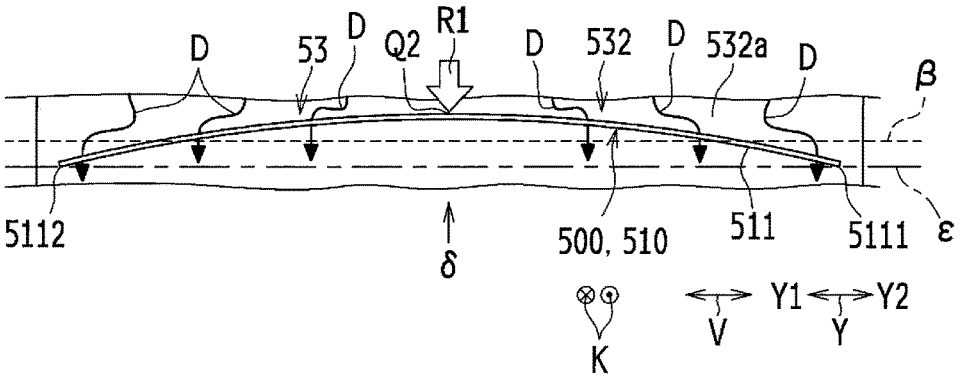
Figure 24C:
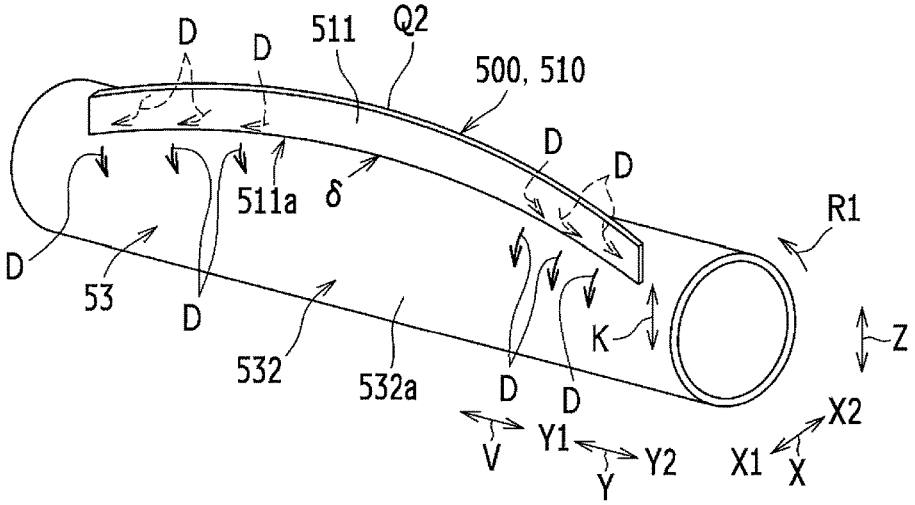

FIGS. 23A to 23C are diagrams for explaining an example of a developer-moving board 511 of a sixth shape which has a U or substantially U shape. FIG. 24A is a schematic plan view of the developer-moving board 511. FIG. 24B is a plan view schematically showing a state where the developer-moving board 511 is disposed so that a virtual straight line ε connecting both ends 5111 and 5112 of the developer-moving board 511 in the longitudinal direction L is parallel or substantially parallel to the axis of revolution β of the developing sleeve 532. FIG. 24C is a perspective view of the developer-moving board 511. It should be noted that FIGS. 24A to 24C show a state where the developer-moving board 511 is at a clearance from the developing sleeve 532.

The developer-moving board 511 of the sixth shape has a U or substantially U shape when viewed in a radial direction of the developing sleeve 532.

This allows the developer-moving board 511 to have a comparatively simple shape, thus making it possible to simply and easily manufacture the developer-moving board 511 accordingly. This also makes it possible to certainly move the developer D in the direction of intersection (e.g. the axial direction of revolution V).

Note here that the developer-moving board 511 of the U or substantially U shape is disposed to project upstream in the direction of revolution R1.

According to this configuration, the developer D on the surface 532*a* of the developing sleeve 532 changes its flow near an upstream side of the developer-moving board 11 in the direction of revolution R1 and, at the vertex Q2 of the U or substantially U shape, starts to flow toward two sides along a surface of contact of the developer-moving board 511 with the developer D. Furthermore, in a case where the developer-moving board 511 is at a clearance from the developing sleeve 532, the developer D flows in the direction of revolution R1 after passing through the opposed section 511*a* of the developer-moving board 511. Further, in a case where the developer-moving board 511 is in contact with the developing sleeve 532, the developer D flows in the direction of revolution R1 after passing through both outer sides of the developer-moving board 511 in the longitudinal direction L.

According to this configuration, in a case where the developer-moving board 511 is at a clearance from the developing sleeve 532, damage to at least either the developer-moving board 511 or the developing sleeve 532 by contact of the developer-moving board 511 with the developing sleeve 532 can be avoided.

Further, in a case where the developer-moving board 511 is disposed so that the virtual straight line ε connecting both ends 5111 and 5112 of the developer-moving board 511 in the longitudinal direction L is parallel or substantially parallel to the axis of revolution β of the developing sleeve 532 (see FIG. 24B), the virtual straight line ε allows the developer D to more certainly move toward the two sides of the direction of intersection (e.g. the axial direction of revolution V) (e.g. toward the two sides opposite to each other across the central or substantially central part δ in the direction of intersection in a case where the vertex Q2 of the U or substantially U shape is located at the central or substantially central part δ in the direction of intersection).

Specifically, the developer-moving board 511 is configured such that a board having a rectangular or substantially rectangular shape as a whole when viewed from the side is curved along the transverse direction K.

It should be noted that the developer-moving board 511 of the sixth shape may be combined with any one of the second to fourth shapes.

Regarding Developer-moving Boards of First to Sixth Shapes

Note here that in a case where the developer-moving board 511 of any of the first to sixth shapes is in contact with the developing sleeve 532, it is preferable that the opposed section 511*a* of the developer-moving board 511 opposed to the developing sleeve 532 make total contact with the developing device 532. Further, in a case where the developer-moving board 511 is at a clearance from the developing sleeve 532, it is preferable that the distance between the developer-moving board 511 and the developing sleeve 532 be uniform or substantially uniform across the longitudinal direction L.

Ninth Embodiment

Length of Developer-moving Board

The developer-moving board 511 of any of the first to sixth shapes may be configured such that the length of the developer-moving board 511 in the axial direction of revolution V is equal to or larger than the width of the opening 51*a* of the developer tank 51 in the axial direction of revolution V or is smaller than the width of the opening 51*a* of the developer tank 51 in the axial direction of revolution V. In a case where the length of the developer-moving board 511 in the axial direction of revolution V is smaller than the width of the opening 51*a* (see FIGS. 2 and 3) of the developer tank 51 in the axial direction of revolution V, the length of the developer-moving board 511 in the axial direction of revolution V can be made shorter by the amount of movement of the developer in the direction of intersection (e.g. the axial direction of revolution V), allowing for the movement of the developer D in the direction of intersection by the developer-moving board 511.

Tenth Embodiment

Material for Developer-moving Board

Incidentally, the developer-moving board 511 may be made of any material that has the strength to receive the developer D being conveyed on the surface 532*a* of the developing sleeve 532 and change the direction of flow of the developer D from the direction of revolution R1 to the direction of intersection (e.g. the axial direction of revolution V), it is desirable that the developer-moving board 51 be made of a material that is comparatively inexpensively and easily available.

In this regard, in a possible example of an aspect of any of the fifth to eighth embodiments, the developer-moving board 511 may be made of metal, resin, ceramic, or a combination of at least two thereof.

In this way, the developer moving board 511 may be made of any material that has the strength to receive the developer D being conveyed on the surface 532*a* of the developing sleeve 532 and change the direction of flow of the developer D from the direction of revolution R1 to the direction of intersection (e.g. the axial direction of revolution V) and that is comparatively inexpensively and easily available. Examples of metal materials of which the developer-moving board 511 can be made include, but are not limited to, stainless steel, nickel, copper, brass, aluminum, and the like. Examples of resin of which the developer-moving board 511 can be made include, but are not limited to, thermosetting resins such as phenol resin, melamine resin, and polyimide resin; thermoplastic resins such as polyimide resin, polyolefin resin, thermoplastic polyimide resin, polysulfone resin, and polyether resin; carbon resin; and the like.

Other Embodiments

Although, in the present embodiment, the developer D is a two-component developer composed mainly of the toner and the carrier C and the developing device 5 is configured to perform a developing operation with the two-component developer, the developer D may alternatively be a magnetic single-component developer composed mainly of a magnetic toner and the developing device 5 may alternatively be configured to perform a developing operation with the magnetic single-component developer.

The present disclosure is not limited to the embodiments described above but may be carried out in other various forms. Therefore, the embodiments are mere examples in every way and should not be interpreted in a limited way. The scope of the present disclosure is indicated by the scope of the claims and is not bound by the main body of the specification in any way. Furthermore, all modifications and alternations that pertain to the scope of equivalents of the scope of the claims fall within the scope of the present disclosure.

The present disclosure contains subject matter related to that disclosed in Japanese Priority Patent Application JP 2016-186885 filed in the Japan Patent Office on Sep. 26, 2016, the entire contents of which are hereby incorporated by reference.

What is claimed is:

1. A developing device comprising:

a magnet roller;

a developing sleeve that revolves in a predetermined direction of revolution around the magnet roller;

a developer tank having an opening that forms a development region by opening a part of a surface of the developing sleeve in a circumferential direction;

a regulating member that regulates a layer thickness of a developer on the surface of the developing sleeve; and a toner residue reduction member that reduces a residue of a toner adhering directly to the surface of the developing sleeve, wherein the toner residue reduction member is inclined with respect to an axis of revolution of the developing sleeve.

2. The developing device according to claim 1, wherein the toner residue reduction member is so disposed in an outer region around an outside of the developing sleeve as to be in a region other than the development region.

3. The developing device according to claim 1, wherein the magnet roller has a magnetic field non-formation section that forms no magnetic field, and forms a developer release region that releases the developer in the magnetic field non-formation section, and the toner residue reduction member is so disposed in an upstream developer retention region of an outer region around an outside of the developing sleeve as to make contact with the developer on the surface of the developing sleeve, the upstream developer retention region being located between a downstream end of the development region in the direction of revolution and an upstream end of the developer release region in the direction of revolution.

4. The developing device according to claim 1, wherein the magnet roller has a magnetic field non-formation section that forms no magnetic field, and forms a developer release region that releases the developer in the magnetic field non-formation section, and the toner residue reduction member is so disposed in the developer release region of an outer region around an outside of the developing sleeve as to be in contact with the developer on the surface of the developing sleeve.

5. The developing device according to claim 1, wherein the magnet roller has a magnetic field non-formation section that forms no magnetic field, and forms a developer release region that releases the developer in the magnetic field non-formation section, the regulating member is so disposed in an outer region around an outside of the developing sleeve as to be between an upstream end of the development region in the direction of revolution and a downstream end of the developer release region in the direction of revolution, and the toner residue reduction member is so disposed in a downstream developer retention region of an outer region around an outside of the developing sleeve as to make contact with the developer on the surface of the developing sleeve and as to be at a clearance that is equal to or longer than a distance between the regulating member and the developing sleeve from the surface of the developing sleeve, the downstream developer retention region being located between a downstream end of the developer release region in the direction of revolution and the regulating member.

6. The developing device according to claim 1, wherein the toner residue reduction member includes a developer-moving member that moves the developer in a direction of intersection with the direction of revolution.

7. The developing device according to claim 6, wherein the developer-moving member is a developer-moving board.

8. The developing device according to claim 7, wherein the developer-moving board intersects with a tangent to the developing sleeve.

9. The developing device according to claim 7, wherein the developer-moving board has a predetermined shape for moving the developer in the direction of intersection.

10. The developing device according to claim 7, wherein the developer-moving board is made of metal, resin, ceramic, or a combination of at least two thereof.

11. An image forming apparatus comprising the developing device according to claim 1.

* * * * *